US007086572B2

(12) United States Patent
Socier et al.

(10) Patent No.: US 7,086,572 B2
(45) Date of Patent: Aug. 8, 2006

(54) VALVE FOR DISPENSING PRODUCT

(75) Inventors: Timothy R. Socier, Essexville, MI (US); Gregory M. Olechowski, Midland, MI (US); Steven R. Tuckey, Freeland, MI (US); Jason D. Hatton, Essexville, MI (US); Stuart R. Brown, Midland, MI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 10/811,180

(22) Filed: Mar. 26, 2004

(65) Prior Publication Data

US 2005/0211735 A1 Sep. 29, 2005

(51) Int. Cl.
*B65D 37/00* (2006.01)

(52) U.S. Cl. ..... 222/494; 222/212

(58) Field of Classification Search ..... 222/212, 222/490, 491, 494

See application file for complete search history.

(56) References Cited

U.S. PATENT DOCUMENTS

| | | | | |
|---|---|---|---|---|
| 1,122,868 | A * | 12/1914 | Davis | 222/490 |
| D136,098 | S | 8/1943 | Hartman | |
| 2,851,203 | A | 9/1958 | Nowak | |
| 3,063,601 | A | 11/1962 | Hertz | |
| 3,773,233 | A * | 11/1973 | Souza | 222/490 |
| 4,735,334 | A | 4/1988 | Abbott | |
| 4,991,745 | A | 2/1991 | Brown | |
| 5,033,655 | A | 7/1991 | Brown | |
| 5,381,935 | A | 1/1995 | Mock | |
| 5,398,853 | A * | 3/1995 | Latham | 222/491 |
| 5,730,336 | A * | 3/1998 | Lerner | 222/490 |
| 5,954,237 | A * | 9/1999 | Lampe et al. | 222/153.06 |
| 6,176,399 | B1 * | 1/2001 | Schantz et al. | 222/484 |
| 6,427,874 | B1 | 8/2002 | Brown | |
| 6,510,971 | B1 | 1/2003 | Martin | |
| 6,688,501 | B1 | 2/2004 | DeGroot et al. | |
| 2002/0121530 | A1 * | 9/2002 | Socier | 222/494 |

FOREIGN PATENT DOCUMENTS

| | | |
|---|---|---|
| AU | 26719/88 A | 9/1989 |
| CA | 976113 | 10/1975 |
| DE | 1250225 | 9/1967 |
| FR | 1135210 | 12/1956 |
| FR | 2790454 A1 | 9/2000 |
| GB | 2224309 A | 5/1990 |

OTHER PUBLICATIONS

2 Avertising sheets of Aquila entitled "Bouchon á Tartiner ou à Etaler—Bec Verseur—" and "Bouchon à Tartiner ou à Éaler—Nouveau Bec Verseur-."

* cited by examiner

*Primary Examiner*—Joseph A. Kaufman
(74) *Attorney, Agent, or Firm*—Wood, Phillips, Katz, Clark & Mortimer

(57) ABSTRACT

A valve is provided with a peripheral attachment portion by which the valve may be attached to a dispensing structure through which can be discharged a product from a supply of the product. The valve includes a flexible, peripheral sleeve extending from the peripheral attachment portion. The sleeve has a central elongate portion and two shorter end portions at opposite ends of the elongate portion so that the central elongate portion and the two shorter end portions together define an interior volume. The valve also has a flexible, elongate head extending from the peripheral sleeve. The head includes at least one elongate slit defining two, opposed, elongate, openable regions in the head which are normally closed and which open to permit the discharge of the product therethrough in response to a pressure differential across the head.

20 Claims, 26 Drawing Sheets

FIG. 3
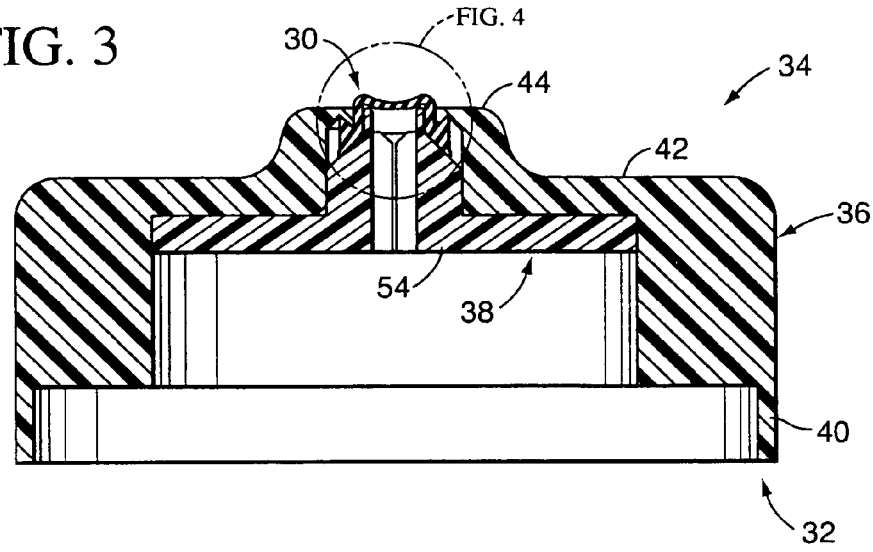
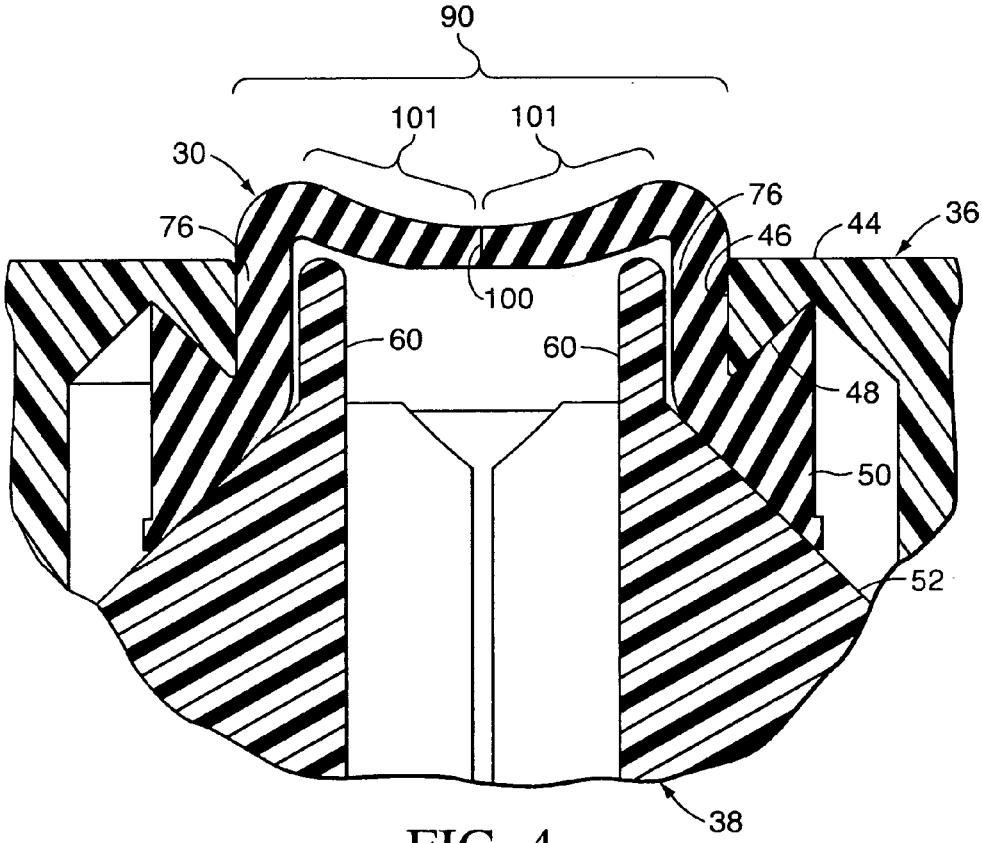
FIG. 4

VALVE FOR DISPENSING PRODUCT

CROSS REFERENCE TO RELATED APPLICATION(S)

Not Applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a valve which is especially suitable for use with a container or other system from which a substance can be discharged through the valve.

BACKGROUND OF THE INVENTION AND TECHNICAL PROBLEMS POSED BY THE PRIOR ART

A variety of packages, including dispensing packages or containers, have been developed for dispensing beverages, fluent food products, personal care products such as shampoo, lotion, etc., as well as other materials. Such containers typically have an open upper end on which is mounted a dispensing end structure which may be a unitary part of the container or a separate closure that is releasably or permanently mounted to the container.

One type of dispensing end structure used with these kinds of containers has a flexible, pressure-openable, self-sealing, slit-type dispensing valve mounted in the end structure over the container opening. The term "pressure-openable" refers to a valve which opens when a sufficient pressure differential is applied across the valve (e.g., as by increasing the pressure on one side and/or decreasing the pressure on the other side). Such a valve is typically used on a container which has a flexible, but resilient, wall or walls. When the container is squeezed, the pressure inside the container increases. This causes the valve slit or slits to open, and the fluid contents of the container are discharged through the open valve. Typically, the valve automatically closes to shut off fluid flow therethrough upon removal of the increased pressure—even if the container is inverted so that the closed valve is subjected to the weight of the contents within the container. Designs of such valves are illustrated in the U.S. Pat. Nos. 5,271,531, 5,033,655, and 4,931,775.

When a separate end closure is employed for attachment to the container, the closure typically includes a body mounted on the container to hold the valve over the container opening. A lid can be provided for engaging the closure body to cover the valve during shipping and when the container is otherwise not in use. See, for example, FIGS. 31–34 of U.S. Pat. No. 5,271,531. Such a lid can be designed to prevent leakage from the valve under certain conditions. The lid can also keep dust and dirt from the valve and/or can protect the valve from damage.

The inventors of the present invention have determined that it would be advantageous to provide a new type of dispensing valve in, or as part of, a dispensing end structure or closure that can provide certain operational advantages. It would be particularly beneficial to provide such a new type of valve with the capability for dispensing a product in a relatively wide configuration, such as in a plurality of separate side-by-side discharge streams or in a single wide discharge stream that would be especially suitable for a spreadable product discharged in a wide ribbon configuration, thereby eliminating, or at least minimizing, the need to use an implement to spread the product.

It would also be desirable to optionally provide such an improved valve with the capability for permitting in-venting of ambient atmosphere after dispensing product from a squeezable, resilient container on which the valve is mounted.

Such an improved valve could also have the capability for effecting a seal between the atmosphere and the product when the valve is closed so as to protect the product from contamination and/or dehydration.

Further, it would be beneficial if such an improved dispensing valve could function as a part of a closure that does not necessarily require the use of a lid.

It would also be desirable to provide a valve which could allow the user to invert the package (consisting of the container, product in the container, and valve on the container) without product leakage, thereby providing the user with more control over the product dispensing operation.

It would also be desirable to provide an improved dispensing valve that could dispense product at a relatively high flow rate compared to conventional valves of similar size.

It would also be beneficial if such an improved dispensing valve could be readily retained in a closure that could optionally accommodate the employment of an ancillary lid and/or frangible, tamper-evident cover or tear band.

An improved dispensing valve should also accommodate designs which permit incorporation of the valve as a unitary part, or extension, of the container as well as designs that separately mount the dispensing system (e.g., separate closure) on the container in a removable or non-removable manner.

It would also be beneficial if such an improved dispensing valve could readily accommodate its manufacture from a variety of different materials.

Further, it would be desirable if such an improved dispensing valve could be provided with a design that would accommodate efficient, high-quality, large volume manufacturing techniques with a reduced product reject rate.

Preferably, the design of the improved dispensing valve should also accommodate high-speed manufacturing techniques that can produce such valves with consistent operating characteristics unit-to-unit with high reliability.

The present invention provides an improved dispensing valve which can accommodate designs having the above-discussed benefits and features.

SUMMARY OF THE INVENTION

According to one aspect of the present invention, a dispensing valve is provided for discharging fluent contents, especially contents from the interior of a container, over a wide target area for deposition, or spreading, on a substrate or other target area. The valve is preferably self-sealing after being opened. The valve includes the following:

(1) a peripheral attachment portion by which the valve may be attached to a dispensing structure through which can be discharged a product from a supply of the product such that the discharging product generally defines a flow direction from the valve into the ambient environment;

(2) a flexible, peripheral sleeve that extends from the peripheral attachment portion and wherein (a) the sleeve, or at least part of the sleeve, extends generally parallel to the flow direction to a location either outwardly or inwardly of the peripheral attachment portion, and (b) the sleeve, when viewed from the ambient environment, has a plan view configuration comprising a central elongate portion and two shorter end portions at opposite ends of the central elongate portion; and (3) a flexible, elongate head extending generally laterally from the peripheral sleeve, wherein the head has a thickness and includes at least one elongate slit through the thickness defining two, opposed openable regions in the head which (a) each has at least one transverse face for sealing against a transverse face of the other openable region, and (b) are normally closed but open to permit the discharge of the product therethrough in response to a pressure differential across the head.

The valve can discharge or dispense a viscous product over a relatively wide target area. A preferred embodiment is especially suitable for dispensing product in a ribbon-like shape to eliminate, or at least minimize, the need to spread the product with an implement.

In one form of the invention, the valve includes a plurality of pairs of two crossing or intersecting, elongate slits spaced along a row. In another form of the invention, the valve has a single pair of intersecting cross slits wherein one slit is longer than the other one. In another form of the invention, the valve has one elongate slit and two short slits at each end of, and perpendicular to, the elongate slit so as to define two petals, each petal having a long edge along the elongate slit and two short end edges—one short edge at each end of the elongate slit.

The valve may optionally have the capability to accommodate in-venting of ambient atmosphere.

In one preferred form of the invention, the valve is part of an assembly of components that together function as a separate closure. The closure is adapted for being releasably or permanently mounted to a container which has an opening to the container interior. The preferred form of the closure includes a multi-piece housing or body for (a) retaining the valve therein, and (b) being mounted on the container at the container opening so as to position the valve over the container opening.

Optionally, a lid may be provided for engaging the closure housing. The lid may be hingedly attached to the closure housing (or container), or may be a completely separate, removable component.

Numerous other advantages and features of the present invention will become readily apparent from the following detailed description of the invention, from the claims, and from the accompanying drawing.

BRIEF DESCRIPTION OF THE DRAWINGS

In the accompanying drawings that form part of the specification, and in which like numerals are employed to designate like parts throughout the same.

FIG. 3 is a cross-sectional view taken generally along the plane 3—3 in FIG. 2;

FIG. 4 is a greatly enlarged, fragmentary, cross-sectional view of the area in the broken line circle in FIG. 3;

DESCRIPTION OF THE PREFERRED EMBODIMENT

Figure 1:
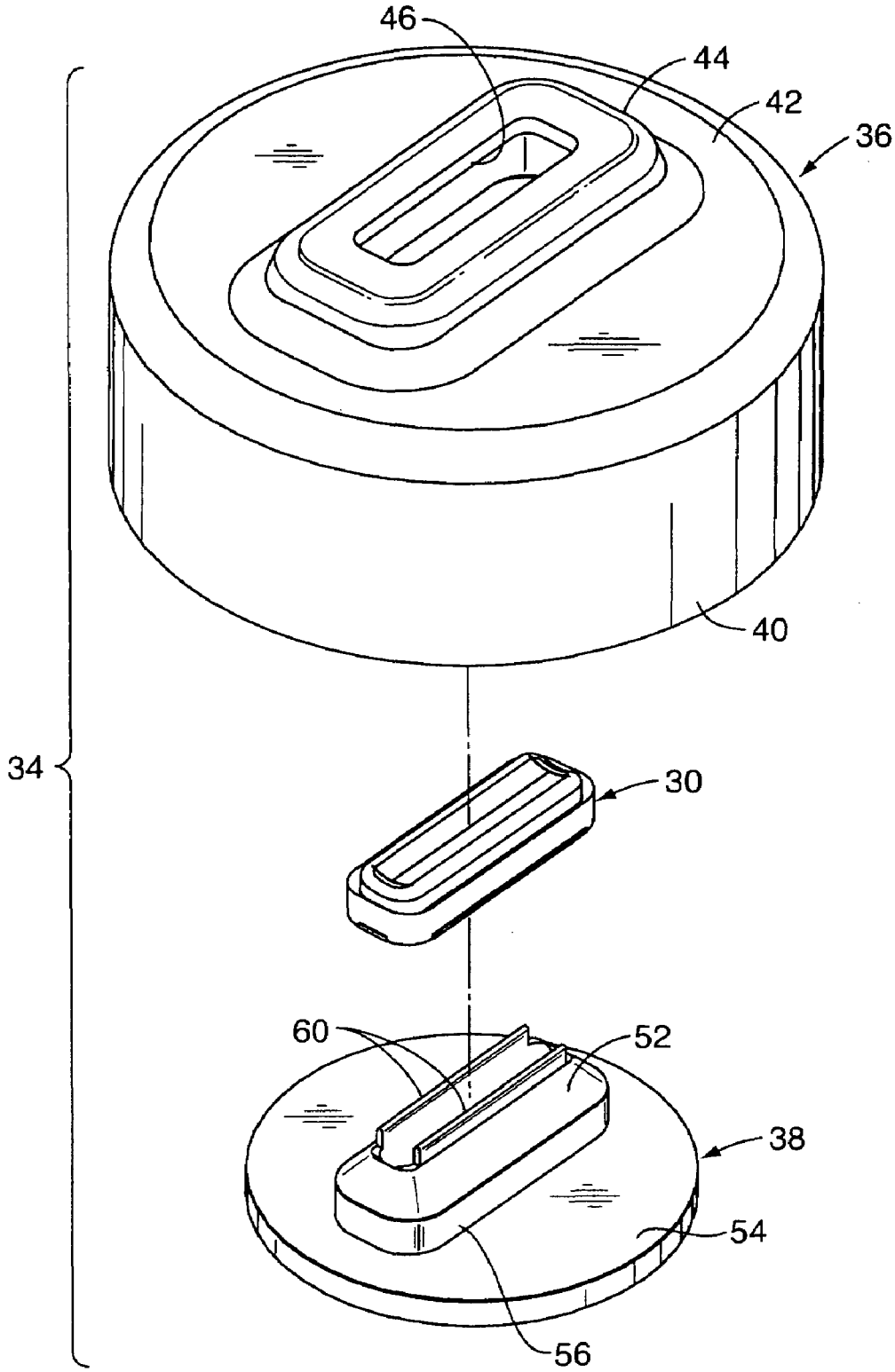
FIG. 1 is an exploded, perspective view showing a preferred, first embodiment of the closed, dispensing valve of the present invention in one optional arrangement wherein it is retained in, and forms part of, a separate closure that is adapted to be mounted on a container.
Figure 2:
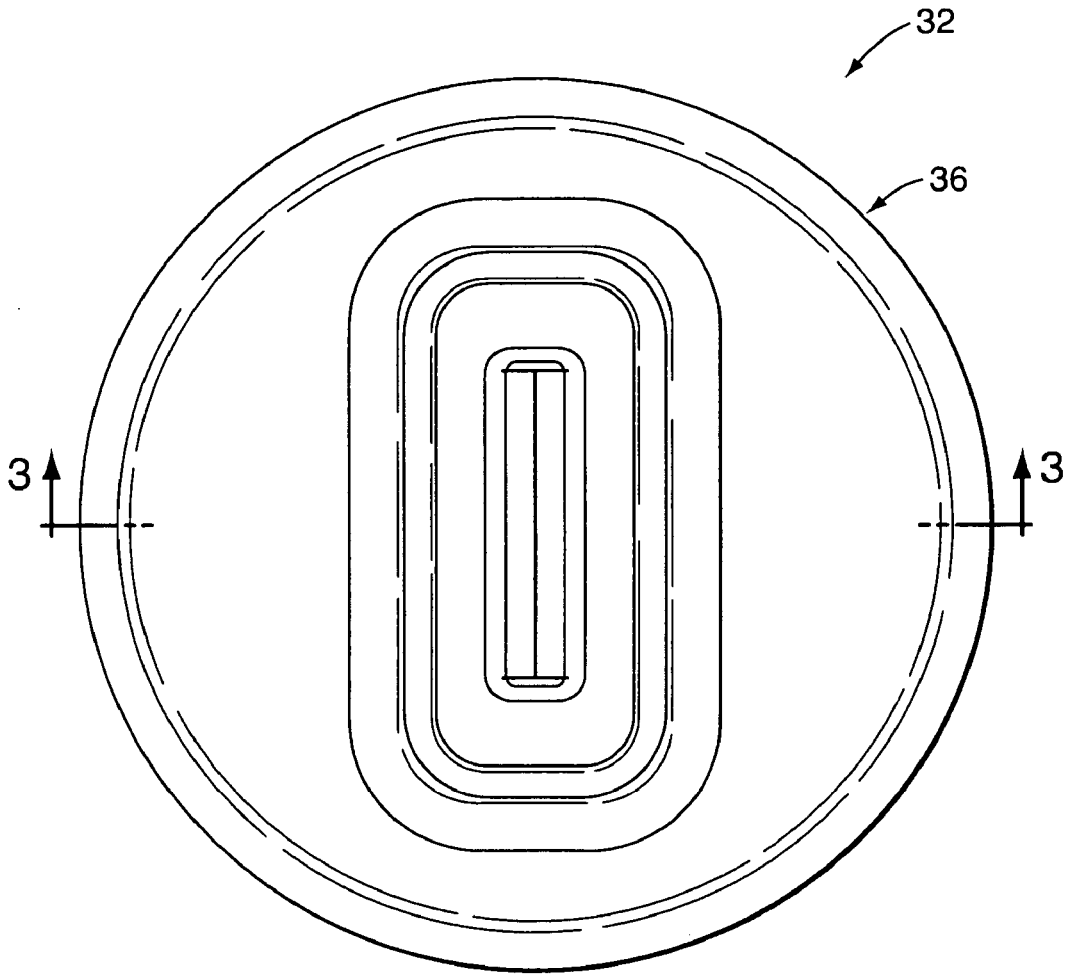
FIG. 2 is a top plan view of the closure shown in FIG. 1 after the components have been assembled.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the dispensing valve of this invention is described in one, generally upright orientation. It will be understood, however, that the dispensing valve of this invention may be manufactured, stored, transported, used, and sold in orientations other than the position described.

One presently preferred, first embodiment of the dispensing valve of the present invention is illustrated in FIGS. 1–14 and is designated therein with reference number 30. The valve 30 is adapted to be mounted in a multi-piece housing 32 (FIG. 3). Together, the valve 30 and housing 32 function as, and define, a dispensing closure designated generally by the reference number 34 in FIGS. 1 and 3.

The dispensing closure 34, which is hereinafter sometimes referred to more simply as the "closure 34," is provided as a separately manufactured unit or subassembly for mounting to the top of a container (not shown). It will be appreciated, however, that in some applications it may be desirable for the dispensing closure 34 to be formed as a unitary part, or extension, of the container wherein the unitary part or extension defines a dispensing end structure that is a part of the container per se.

The container (not shown) typically has a conventional mouth which provides access to the container interior and product contained therein. The product may be, for example, a fluid or spreadable comestible product, such as peanut butter, jam, mayonnaise, etc. The product could also be any other fluent or spreadable material, including, but not limited to, powders, creams, lotions, slurries, pastes, etc. Such materials may be sold, for example, as a food product, a personal care product, an industrial or household product, or other composition (e.g., for internal or external use by humans or animals, or for use in activities involving medicine, manufacturing, commercial or household maintenance, construction, agriculture, etc.).

The container typically may have a neck or other suitable structure defining the container mouth. The neck may have (but need not have) a circular cross-sectional configuration, and the body of the container may have another cross-sectional configuration, such as an oval cross-sectional shape, for example. The container may, on the other hand, have a substantially uniform shape along its entire length or height without any neck portion of reduced size or different cross-section.

The container typically may be a squeezable container having a flexible wall or walls which can be grasped by the user and compressed to increase the internal pressure within the container so as to squeeze the product out of the container through the closure 34 when the closure 34 is open. Such a container wall typically has sufficient, inherent resiliency so that when the squeezing forces are removed, the container wall tends to return to its normal, unstressed shape, and tends to draw ambient atmosphere into the container through the closure to the extent that the closure is an open mode or in-venting mode (described in detail hereinafter). Such a squeezable container structure is preferred in many applications, but may not be necessary or preferred in other applications. Indeed, the container may be substantially rigid. A piston could be provided in such a rigid container to aid in dispensing a product, especially a relatively viscous product. On the other hand, a rigid container could be employed for inverted dispensing of the product under the influence of gravity acting on the mass of the discharging product and/or under the influence of a reduced ambient pressure at the exterior of the container (e.g., as created by sucking on the open closure 34).

As shown in FIG. 1, the closure multi-piece housing 32 comprises a body 36 and an insert retainer 38. The body 36 may have a skirt 40 (FIG. 3) with a conventional internal thread (not illustrated) for engaging a mating container thread (not shown) to secure the closure body 36 to the container (not shown).

The closure body 36 and container could also be releasably connected with a snap-fit bead and groove, or by other means. Alternatively, the closure body 36 may be permanently attached to the container by means of induction bonding, ultrasonic bonding, gluing, or the like, depending upon the materials employed for the container and closure body 36. Further, the closure body 36 could, in some applications, be formed as a unitary part, or extension, of the container.

The illustrated preferred, first form of the closure body 36 defines a radially inwardly extending, annular deck 42 (FIGS. 1 and 3). The interior of the body 36 may include special or conventional seal features (not illustrated) to provide a leak-tight seal between the closure body 36 and the container.

As can be seen in FIGS. 1 and 3, the body 36 includes a short spout-like formation 44 projecting upwardly from the body deck 42. As can be seen in FIGS. 1 and 4, the spout-formation 44 defines an aperture or opening 46 which has a generally elongate, rectangular shape with rounded corners. The body deck opening 46 is adapted to receive an upper portion of the valve 30 when the valve 30 is mounted within the closure body 36, as illustrated in FIGS. 3 and 4.

The interior of the closure body spout formation 44 adjacent the opening 46 defines a generally angled clamping surface 48 (FIG. 4) around the periphery of the opening 46. The angled clamping surface 48 is adapted to engage a peripheral attachment portion, or flange, 50 of the valve 30 described in more detail hereinafter. The peripheral attachment portion 50 of the valve 30 is clamped against the closure body angled clamping surface 48 by the insert retainer 38 which, as shown in FIGS. 1 and 4, defines an angled clamping surface 52 for engaging the valve flange 50.

As illustrated in FIG. 1, the insert retainer 38 has a generally disc-like portion 54, an upwardly extending protuberance 56 from which projects the angled clamping surface 52, and a pair of spaced-apart, generally parallel, upwardly projecting support walls 60. As can be seen in FIG. 4, each support wall 60 is adapted to project up inwardly inside the interior of the valve 30, and each support wall 60 is adapted to lie adjacent a portion of the long interior surface or wall of the valve 30.

As illustrated in FIG. 3, the disc portion 54 of the insert retainer 38 is adapted to be received within the closure body 36 below the closure body deck 42. The insert retainer 38 may be held within the closure body 36 by suitable snap-fit engagement features (not illustrated) or by any other suitable permanent or releasable fixing means such as, for example, adhesive, ultrasonic bonding, a threaded connection, or the like. Typically, during assembly of the components of the closure 34, the valve 30 is initially disposed within the closure body spout formation 44 adjacent the clamping surface 48, and then the insert retainer 38 is inserted into the closure body 36 and fixed therein so as to clamp the valve 30 securely in place within the closure body 36. The assembly of the insert retainer 38 and closure body 36 together may be characterized as the closure housing 32. The two-piece closure housing 32, together with the installed valve 30, define the fully assembled, separate closure 34.

In the preferred, first embodiment illustrated in FIGS. 1–14, the closure body 36 and insert retainer 38 are preferably molded from a suitable thermoplastic material such as polypropylene or the like. Other materials may be employed instead.

In other contemplated embodiments, the closure housing 32 need not be a multi-piece structure comprising the body 36 per se and retainer 38 per se. Further, the closure housing 32 need not be a structure that is completely separate from the container. Instead, the container per se could be made with a dispensing end structure that incorporates the insert retainer 38 as a unitary part of the container. Also, the closure body spout formation 44 could be initially provided as an upstanding, deformable, pre-form wall on the container distal end for being subsequently permanently deformed around the valve 30 after the valve 30 is positioned on the unitary container extension. This could be accomplished, for example, with an ultrasonic energy deformation process if the upstanding pre-form wall is molded as a unitary part of the container from a suitable thermoplastic material.

Alternatively, the spout formation 44 could be provided as a separate member which is subsequently attached by suitable releasable or permanent means to the upper end of the container over the valve flange 50 after the valve 30 has been appropriately mounted in position at the upper end of the container.

In any of the above-discussed alternatives, the container may have a bottom end (i.e., the end opposite the dispensing end in which the valve 30 is mounted), and that bottom end could be initially left open for accommodating the filling of the container with the product to be dispensed. After the container is filled with the product through the open bottom end of the container, the open bottom end of the container could be closed by suitable means, such as by a separate bottom end closure which could be attached to the container bottom end through a suitable threaded engagement, snap-fit engagement, adhesive engagement, thermal bonding engagement, etc. Alternatively, such an open bottom portion of the container could be squeezed closed with an appropriate heat and force applying process if the container bottom portion is made from a thermoplastic material or from other materials that would accommodate the use of such a process.

The valve 30 may be mounted via its peripheral attachment portion or flange 50 within the other components of the closure 34, or to some other dispensing structure, through which can be discharged a product from a supply of the product. The discharging product may be characterized as defining a flow direction from the valve into ambient atmosphere.

With reference to FIGS. 5–8, the valve 30 includes the peripheral attachment portion, which, in the preferred form of the invention, is the flange 50 that has a generally dovetail cross-sectional configuration for being clamped between mating angled surfaces of the closure housing 32 (i.e., clamped between the closure clamping surface 48 (FIG. 4) on the top and the insert retainer clamping surface 52 (FIG. 4) on the bottom). This fixes the position of the valve attachment portion or flange 50 of the valve 30 relative to the container on which the closure 34 is mounted.

Figure 5:
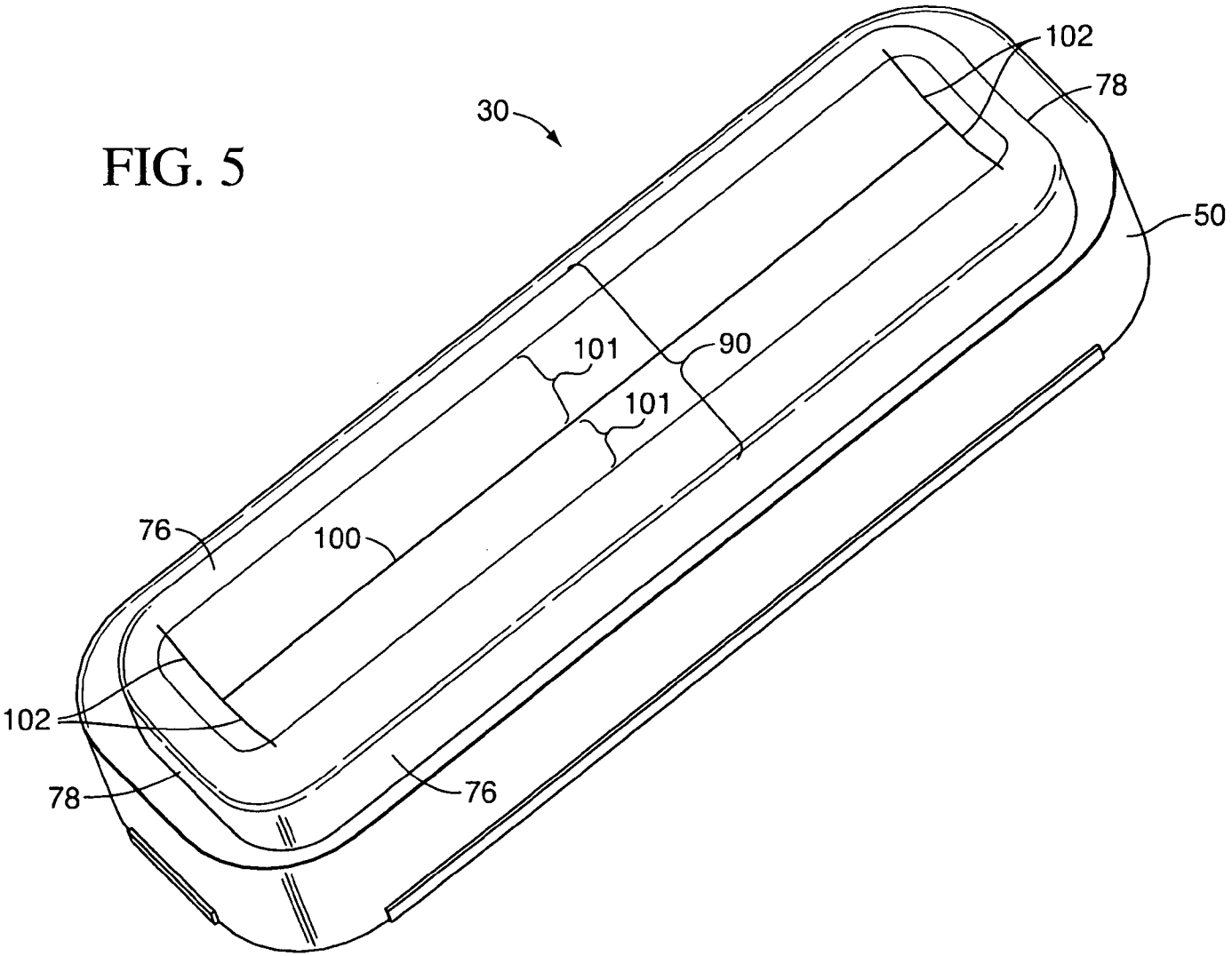
FIG. 5 is a perspective view of the valve alone in the closed condition.

The valve 30 includes a flexible, peripheral sleeve 70 (FIG. 7) extending outwardly (upwardly) from the peripheral attachment portion or flange 50. When viewed from the ambient environment on the exterior side of the valve (FIG. 6), and as identified with element reference numbers in FIG. 8, the sleeve 70 may be regarded as having a hollow, central elongate portion 72 (FIG. 8) and two shorter end portions 74 (FIG. 8) at opposite ends of the elongate portion 72. Together, the hollow, elongate portion 72 an the shorter end portions 74 define an interior volume within the sleeve 70. The central elongate portion 72 of the sleeve 70 may be further characterized including two, spaced-apart, elongate sidewalls 76 (FIGS. 5 and 7). The sleeve's two shorter end portions 74 each comprises an end wall 78 (FIG. 8) joining the sidewalls 76.

Figure 7:
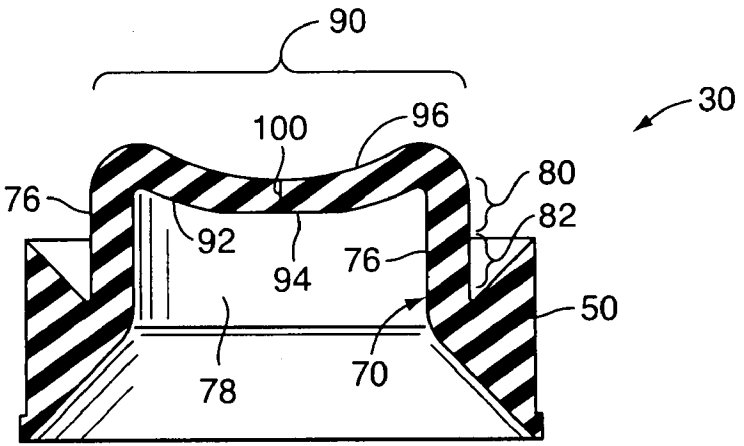
FIG. 7 is a cross-sectional view taken generally along the plane 7—7 in FIG. 6.
Figure 8:
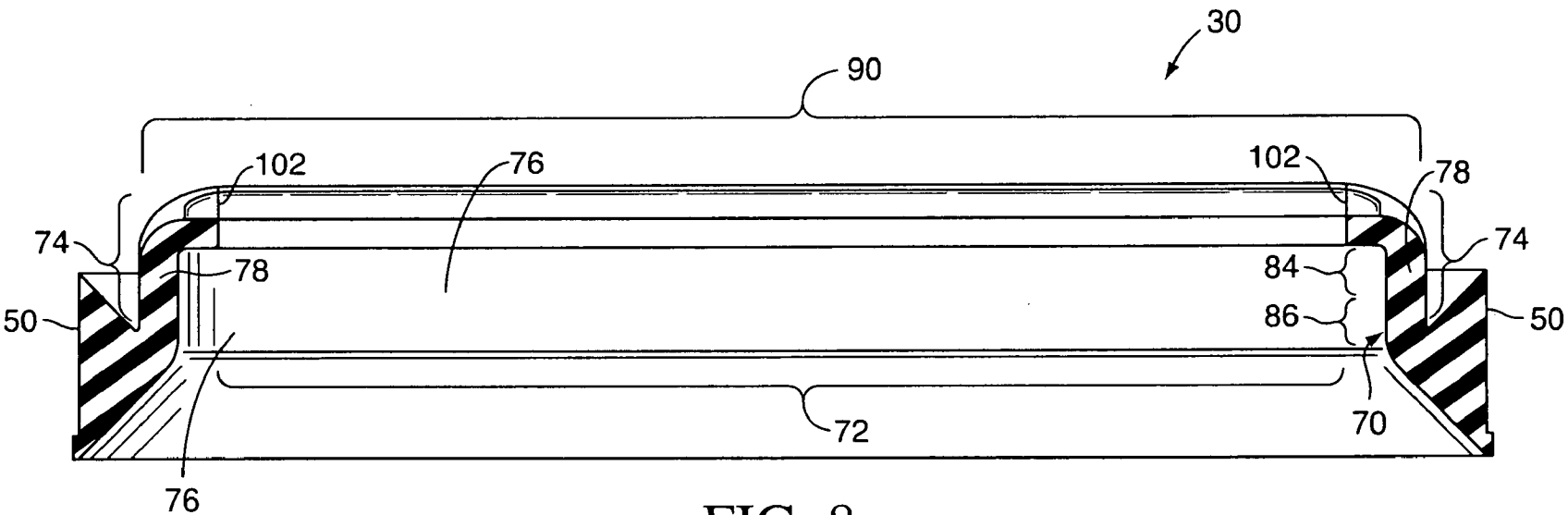
FIG. 8 is a cross-sectional view taken generally along the plane 8—8 in FIG. 6.

As illustrated in FIG. 7, each sidewall 76 has an upper region 80 and a lower region 82. Similarly, as shown in FIG. 8, each sleeve end wall 78 has an upper region 84 and a lower region 86. The lower region 82 of each sidewall 76 and the lower region 86 of each end wall 78 are joined to the peripheral attachment portion 50 so that the peripheral attachment portion 50 may be characterized as extending laterally outwardly from the lower regions of the sleeve sidewalls and end walls.

In the first embodiment illustrated in FIGS. 1–14, the sleeve sidewalls 76 and end walls 78 extend generally parallel to the flow direction (the direction through the valve) to a location outwardly of the peripheral attachment portion or flange 50.

The valve 30 includes a flexible, elongate head 90 as shown in FIG. 7, and the head 90 extends from the upper regions 80 of the sidewalls 76 and from the upper regions 84 of the end walls 78. The head 90 extends over the interior volume defined within the flexible peripheral sleeve 70. The head 90 is generally concave as viewed from the exterior of the valve 30 relative to the interior volume (see FIGS. 7 and 8). The valve head 90 has an interior surface 92 (FIG. 7) that interfaces with the interior volume and which, in the illustrated, preferred, embodiment, includes a central flat area 94 (FIG. 7). As shown in FIG. 7, the valve head 90 has an exterior surface 96 which interfaces with the ambient environment. In another contemplated embodiment, the interior surface 92 need not have a flat area 94. The entire interior surface could be curved, and could be concentric or non-concentric relative to the exterior surface 96.

Figure 9:
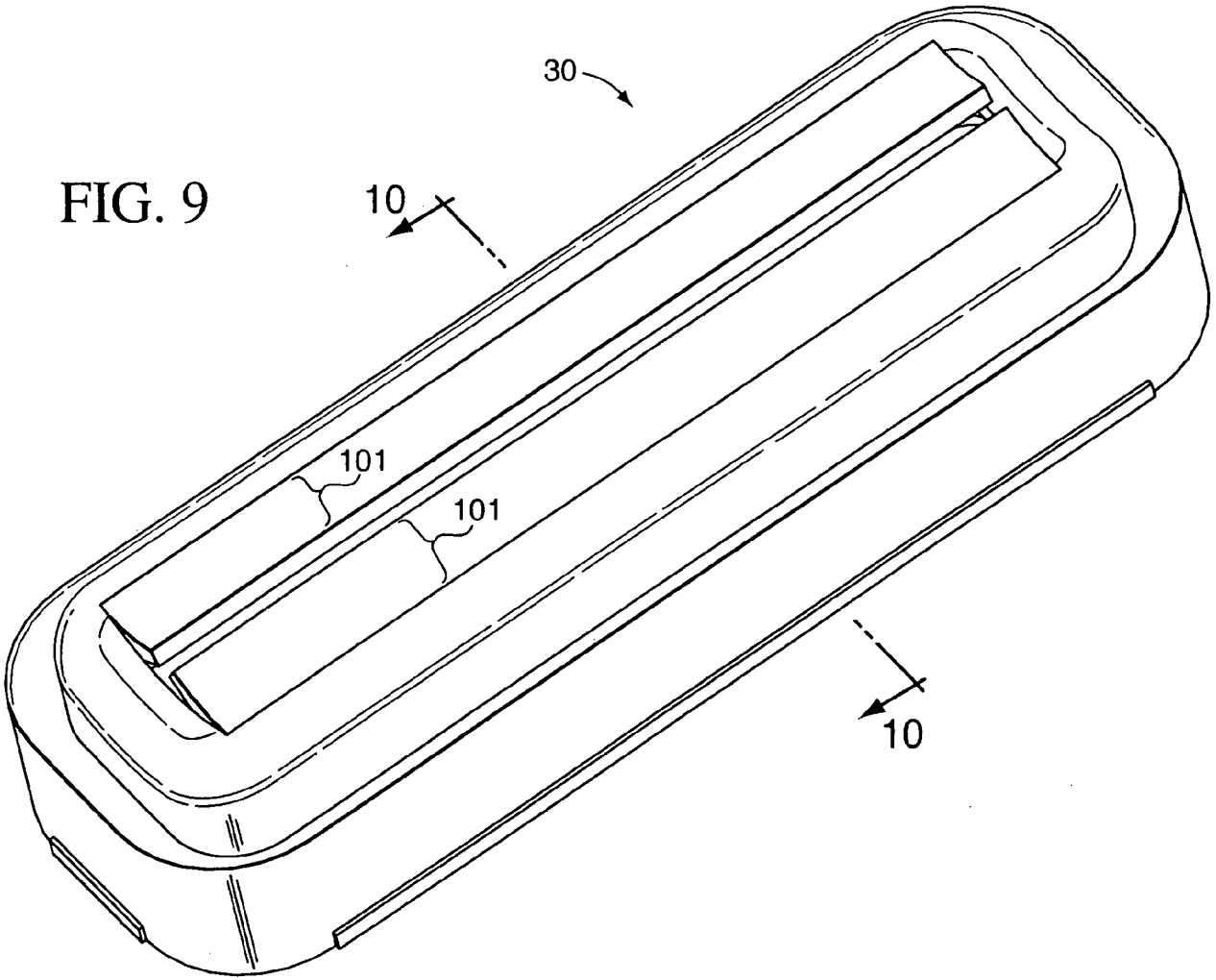
FIG. 9 is a view similar to FIG. 5, but FIG. 9 shows the valve in a partly open condition.
Figure 10:
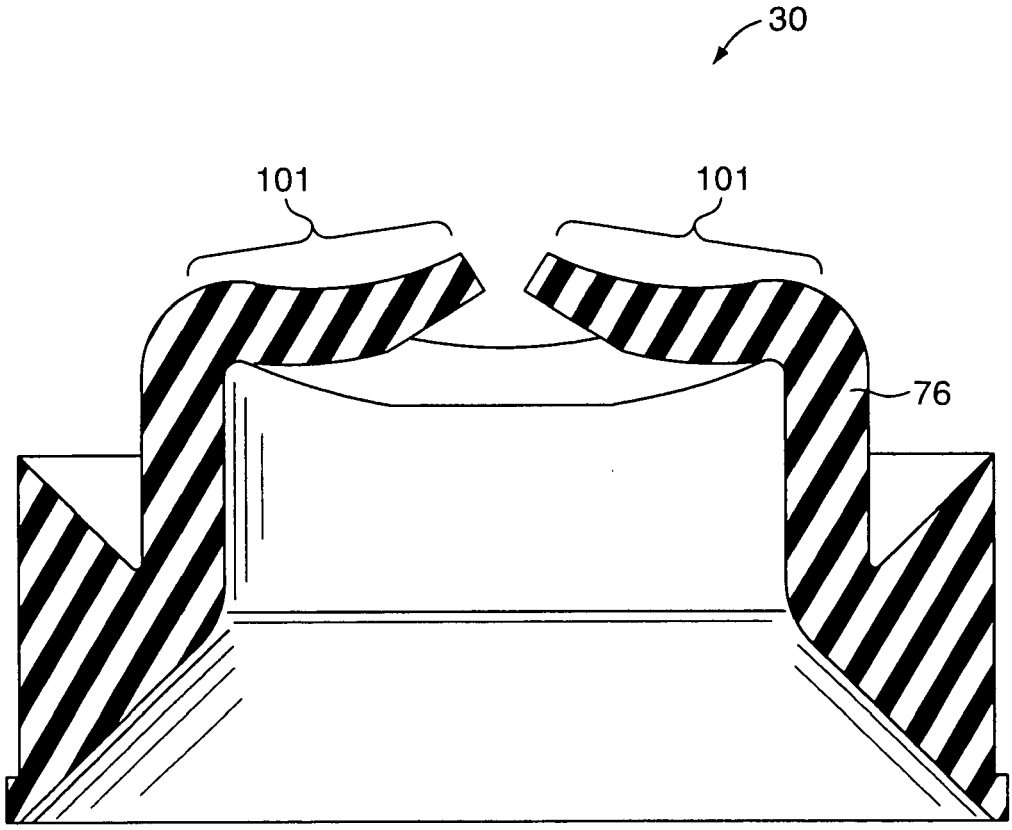
FIG. 10 is a cross-sectional view taken generally along the plane 10—10 in FIG. 9.
Figure 11:
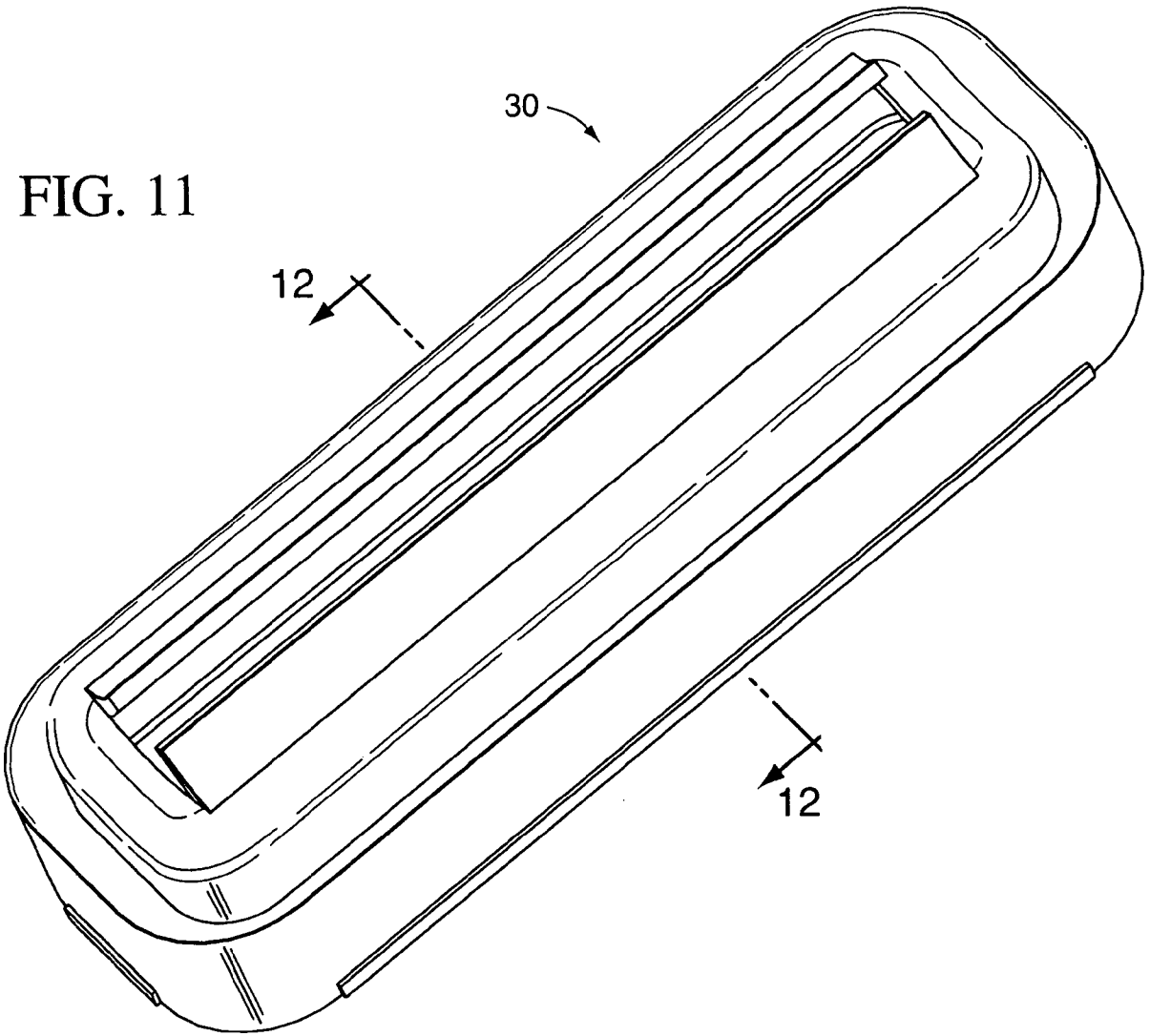
FIG. 11 is a view similar to FIG. 9, but FIG. 11 shows the valve in a more open condition.
Figure 12:
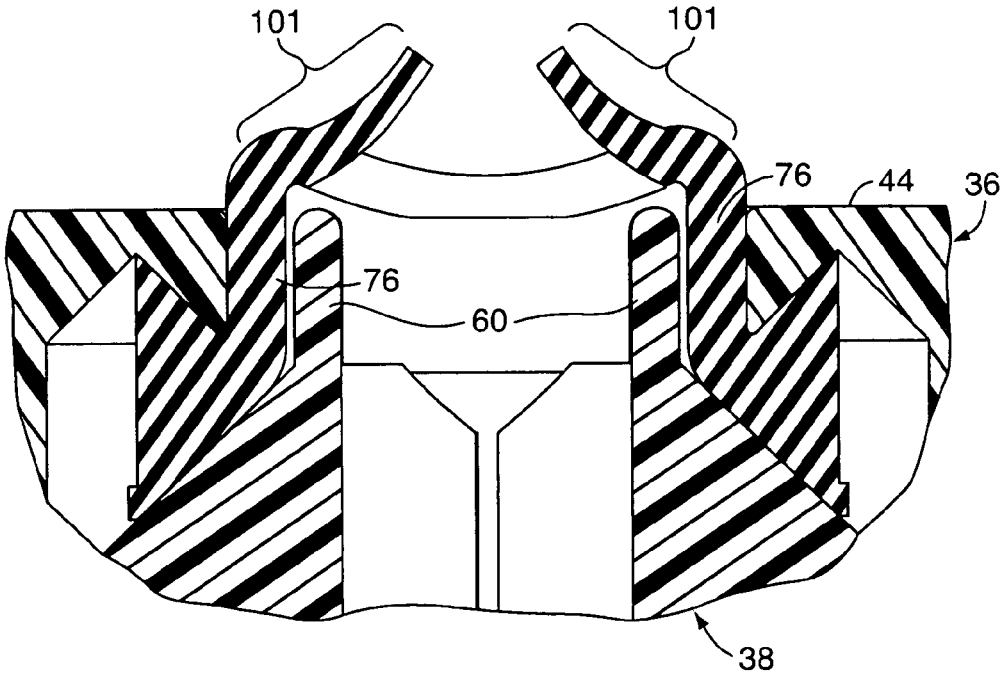
FIG. 12 is a cross-sectional view of the valve taken generally along the plane 12—12 in FIG. 11, but FIG. 12 also shows the valve mounted in the closure housing which is shown in fragmentary cross section.

As shown in FIG. 5, the valve head 90 includes an elongate slit 100 defining two, opposed, elongate, movable, openable regions 101 which are normally closed and which open (as illustrated in FIGS. 9 and 11) to permit the discharge of product therethrough in response to a pressure differential across the head 90. Each opposed region 101 at the slit 100 has a transverse face through the thickness of the head 90 for sealing against the transverse face of the other opposed region 101.

It is to be realized that when the valve 30 is closed as shown in FIGS. 4 and 7, there is no slot or space between the opposing regions of the valve head on either side of the slit 100. That is, when the valve head 90 is closed, the slit 100 does not define any opening or passage between the two, opposed, elongate, movable regions 101. Thus, the two regions 101 are in an abutting, sealing relationship when the valve 30 is in the closed condition.

In the preferred, first embodiment of the valve 30, the valve head 90 further includes two, spaced-apart, short slits 102. Each slit 102 is generally perpendicular to the elongate slit 100. Each slit 102 is located at an end of the elongate slit 100. Each slit 102 communicates with the elongate slit 100 so as to define opposed, door-like, elongate petals at the movable regions 101 wherein each petal may be characterized as comprising a movable region 101 per se, and wherein each such petal (movable region) 101 has a long edge (along the elongate slit 100) and two short edges (along the short slits 102)

In the preferred, first embodiment illustrated in FIGS. 1–14, elongate slit 100 lies along an imaginary plane that (1) passes through the head 90, and (2) is perpendicular to the head inner surface flat area 94 (FIG. 7). The transverse face of each opposed region 101 lies along this imaginary plane (when the valve 30 is closed), and provides the sealing surfaces at the slit 100. Preferably, the valve head regions or petals 101 are thinner along the elongate slit 100 than at locations away from the elongate slit 100.

Figure 6:
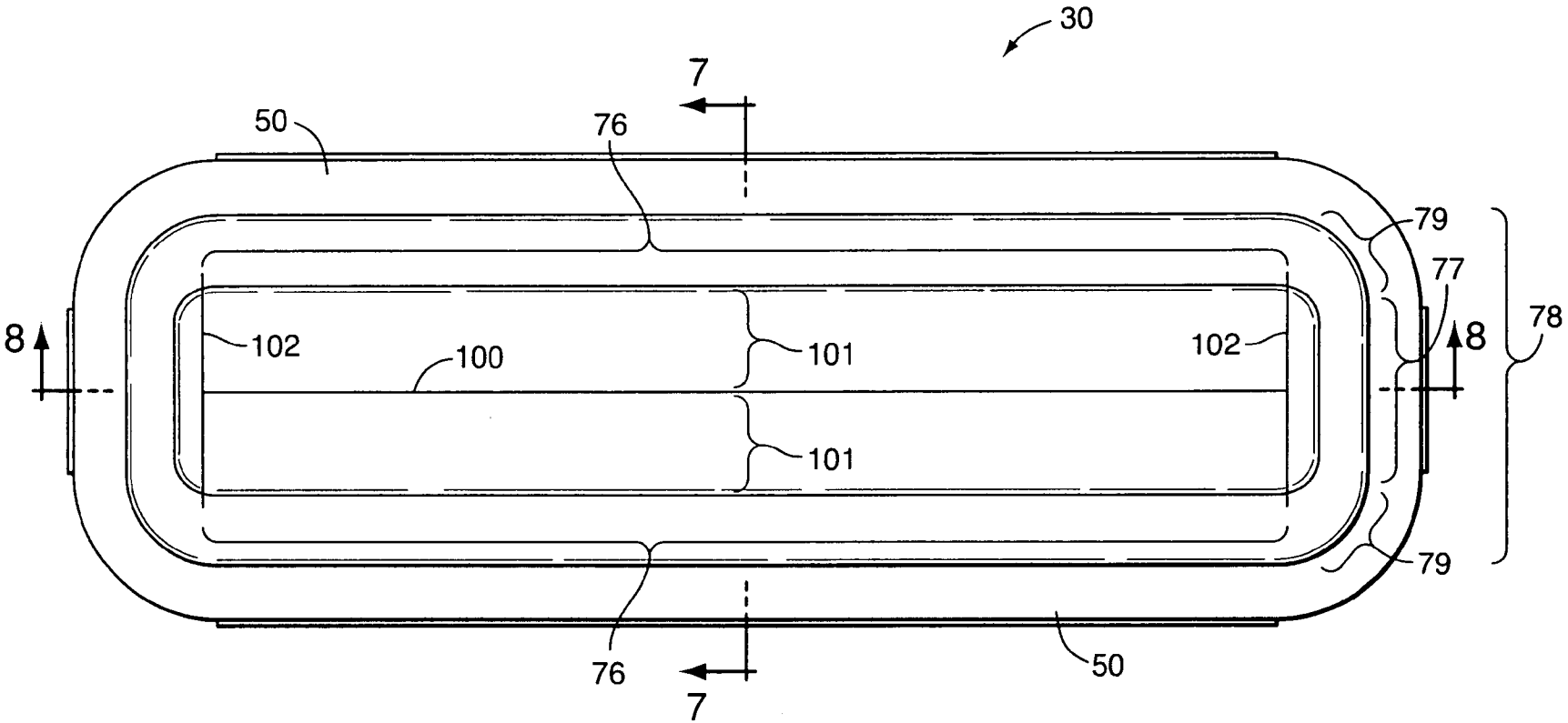
FIG. 6 is a top plane view of the valve as shown in FIG. 5.

As can be seen in FIG. 6, each sleeve end wall 78 includes a straight section 77 between two curved sections 79, and each curved section 79 joins with one of the sidewalls 76. The sleeve end walls 78 may each also be characterized as a defining one of the sleeve's two short end portions 74 (FIG. 8).

Preferably, the length of each sidewall 76 is at least three times the width of the valve head 90 (wherein the length of each sidewall 76 is measured from one short slit 102 to the other short slit 102, and wherein the width of the valve head 90 is measured across the valve head 90 in FIG. 7 from the outermost surface of one sidewall 76 to the outermost surface of the other sidewall 76).

As viewed in the transverse cross section in FIG. 7, a major area of the valve exterior surface 96 lies on a circular arc. As viewed in the transverse cross section in FIG. 7, the two areas of the valve interior surface 92 beyond the flat area 94 each lie along a circular arc. The circular arc surfaces on the exterior and interior of the valve are concentric in the illustrated preferred embodiment.

The valve 30 is preferably molded from an elastomer, such as a synthetic thermosetting polymer, including silicone rubber, such as the silicone rubber sold by Dow Coming Corp. in the United States of America under the trade designation DC 99-595HC. However, the valve 30 can also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

Owing to the unique configuration of the valve 30, the valve 30 normally remains in the closed configuration shown in FIGS. 3–8 unless it is subjected to opening forces. The valve 30 can be moved to an open configuration (FIGS. 9 and 11) by applying a sufficiently large pressure differential across the valve head 90 when the valve 30 is in the closed configuration so that the pressure acting on the exterior of the valve head 90 is lower than the pressure acting on the interior of the valve head 90. Such a pressure differential forces the valve petals 101 upwardly to the open position. The opening pressure differential can be achieved by pressurizing the interior of the container to which the closure 34 is mounted. Typically, the container would have a flexible wall which can be squeezed inwardly by the user to increase the pressure within the container. This can be done while holding the container (with the closure 34 mounted thereon) in an inverted orientation so that the fluent material or other product within the container is squeezed and pressurized against the closed valve 30. As the pressure moves the valve petals 101 to the open positions illustrated in FIGS. 9 and 11, the material or product flows through the open slit 100 and past the open valve petals 101.

The valve 30 could also be opened by a user sucking on the valve with sufficient force to lower the pressure on the valve head exterior surface below the internal pressure acting against the valve head interior surface.

The valve 30 opens to define a wide, or elongate, dispensing passage or orifice which, when used to dispense a viscous fluent product, can discharge the product in a wide or ribbon-like configuration. The ribbon-like discharge of product can be spread with the closure on a substrate or other target area. This closure is especially suitable for dispensing and spreading mayonnaise or peanut butter on bread, as well as for dispensing and spreading non-comestible materials.

If the container on which the closed valve 30 is mounted inadvertently tips over, the product does not flow out of the valve because the valve remains closed. Preferably, the valve 30 is designed to withstand the weight of the fluid on the inside of the valve when the container is completely inverted. Preferably, the valve 30 is designed to open only after a sufficient amount of pressure differential acts across the valve—as by the user sucking on the end of the valve 30 and/or squeezing the container if the container is not a rigid container.

With the preferred form of the valve 30A, if the differential pressure across the valve 30 decreases sufficiently, then the inherent resiliency of the valve will cause it to close. The valve 30 will then assume the closed position illustrated in FIGS. 1–9. However, it is contemplated that the valve 30 could also be designed for a "once-open, stay-open" operation by using appropriate dimensions for the valve head thickness and slit lengths.

In one preferred embodiment, the petals 101 of the valve 30 open outwardly only when the valve head 90 is subjected to a predetermined pressure differential acting in a gradient direction wherein the pressure on the valve head interior surface exceeds—by a predetermined amount—the local ambient pressure on the valve head exterior surface. The product can then be dispensed through the open valve until the pressure differential drops below a predetermined amount, and the petals 101 close completely. If the preferred form of the valve 30 has also been designed to be flexible enough to accommodate in-venting of ambient atmosphere as described in detail below, then the closing petals 101 can continue moving inwardly (FIGS. 13 and 14) to allow the valve to open inwardly as the pressure differential gradient direction reverses and the pressure on the valve head exterior surface exceeds the pressure on the valve head interior surface by a predetermined amount.

Figure 13:
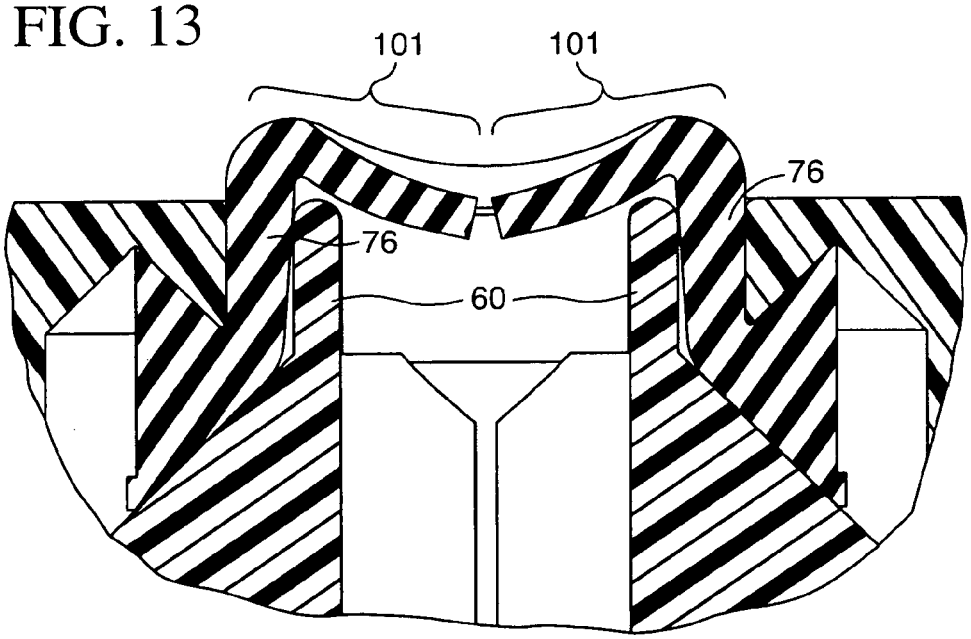
FIG. 13 is a view similar to FIG. 12, but FIG. 13 shows the valve in an in-venting condition.
Figure 14:
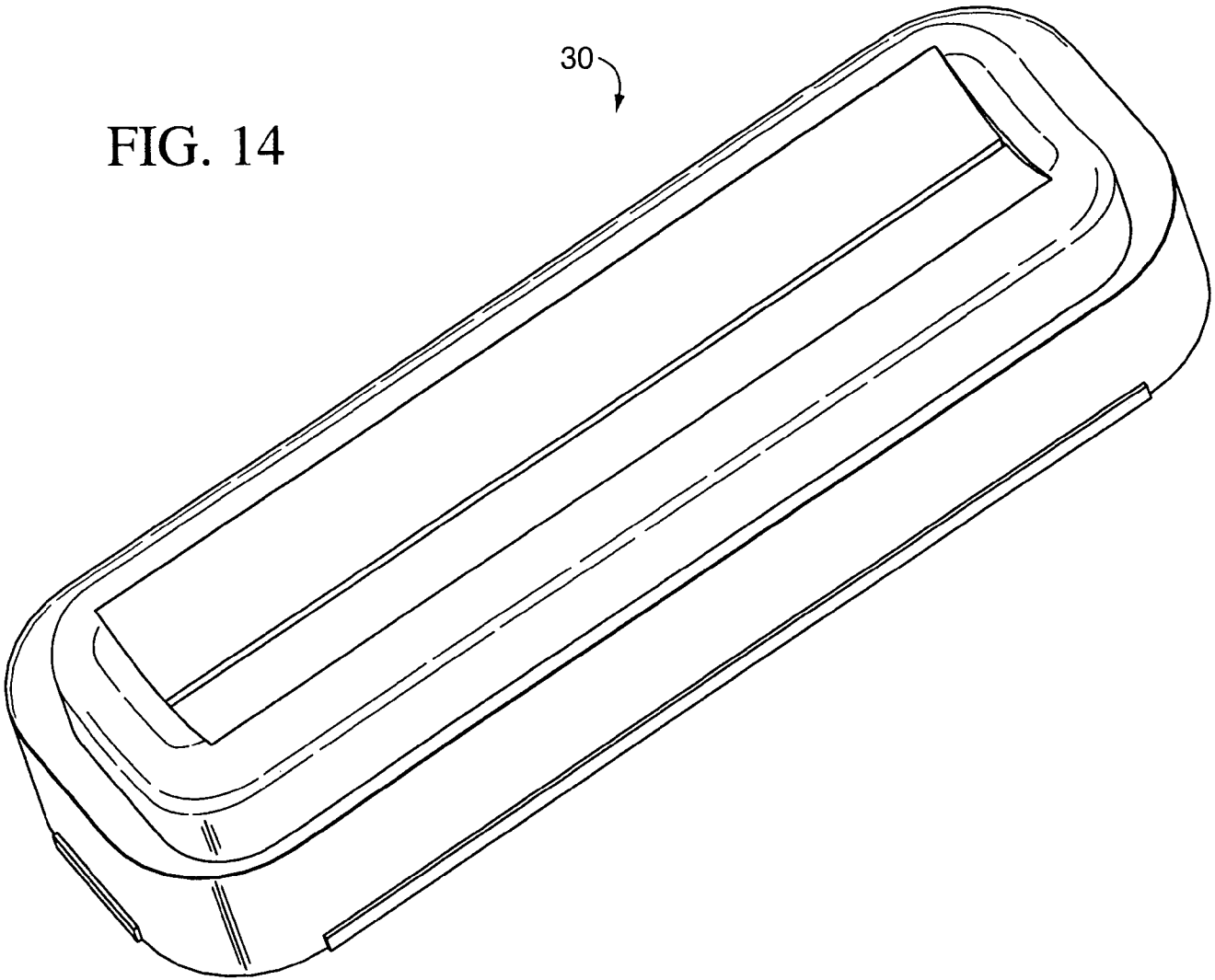
FIG. 14 is a perspective view showing the valve alone in the in-venting condition corresponding to FIG. 13.

For some dispensing applications, it may be desirable for the valve 30 not only to dispense the product, but also to accommodate such in-venting of the ambient atmosphere (e.g., so as to allow a squeezed container (on which the valve is mounted) to return to its original shape). The illustrated, preferred embodiment of the valve 30 has this in-venting capability. Such an in-venting capability can be provided by selecting an appropriate material for the valve construction, and by selecting an appropriate sleeve wall thickness, sleeve shape, head thickness, and head shape for the particular valve material and overall valve size. The degree of flexibility and resilience of the valve, and in particular, of the petals 101, can be designed or established so that the petals 101 will deflect inwardly when subjected to a sufficient pressure differential that acts across the head and in a gradient direction that is the reverse or opposite from the pressure differential gradient direction during product dispensing. Such a reverse pressure differential can be established when a user releases a squeezed, resilient container on which the valve is mounted. The resiliency of the container wall (or walls) will cause the wall to return toward the normal, larger volume configuration. The volume increase of the container interior will cause a temporary drop in the interior pressure. When the interior pressure drops sufficiently below the exterior ambient pressure, the pressure differential across the valve will be large enough to deflect the valve petals 101 inwardly to permit in-venting with the ambient atmosphere (FIGS. 13 and 14). In some cases, however, the desired rate or amount of in-venting may not occur until the squeezed container is returned to a substantially upright orientation that allows the product to flow under the influence of gravity away from the valve.

With some designs of the valve of this invention, it may be desirable in some dispensing applications to have the valve peripheral sleeve 70 be very flexible so as to assist in the opening of the petals 101 at a relatively low pressure differential. A relatively flexible sleeve 70 can permit the petals 101 to more readily bend at or near the top of the sleeve 70, and more readily open outwardly for easy dispensing.

However, such a highly flexible sleeve 70 may be too flexible to provide sufficient stability to permit proper in-venting deflection of the petals 101. Depending on the type of valve material, very thin and long sidewalls (e.g., sidewalls 76 in FIGS. 5–8) tend to be very flexible and may tend to move, or collapse, inwardly toward each other as the valve begins to assume the in-venting configuration. If the very flexible sidewalls 76 bend or sag toward each other, then the valve head petals 101 may be forced together along the slit 100 with enough force to inhibit the inward deflection of the petals 101. In such a situation, the valve petals 101 may not then open inwardly, or may not open inwardly enough to provide the desired amount or rate of in-venting.

In order to ensure proper in-venting through a highly flexible valve 30, a unique internal support system has been devised. One preferred embodiment of the support system includes the retainer insert support walls 60 (FIGS. 1, 4, 12, and 13) inside the valve 30. As can be seen in FIG. 4, the two support walls 60 are preferably designed so that when the valve 30 is in its normal, closed configuration, each valve sidewall 76 does not touch the adjacent support walls 60. A small gap or spacing preferably exists between each support wall 60 and the adjacent valve sidewall 76. This facilitates initial assembly of the closure components and accommodates manufacturing tolerances on the closure components.

During the in-venting process through a valve 30 having very flexible sidewalls 76, each sidewall 76 may tend to bend or deflect toward the adjacent support wall 60 as shown in FIG. 13. The support walls 60 then engage the valve sidewalls 76 and prevent the valve sidewalls 76 from bending toward each other too much. This limits the force of engagement between the valve head petals 101 along the slit 100 as the petals 101 deflect inwardly to the in-venting configuration (FIGS. 13 and 14). Thus, the two petals 101 can readily bend past, and inwardly away from, each other along the slit 100 so that the petals 101 can move to their full in-venting configuration.

Where in-venting is not a desired feature, or where the valve sidewalls 76 are less flexible, the internal support walls 60 may be eliminated.

In some embodiments of the invention, the retainer insert 38 may be eliminated altogether. The valve 30 could be mounted to the container without an insert 38 and by using other suitable attachment systems that would not necessarily even require the use of the illustrated closure body 32 per se.

The two short slits 102 in the head 90 of the valve 30 may be eliminated in some designs for some applications. In such a design, the movable regions 101 would not have end edges and would not have the shape of a door-like petal.

In the first embodiment illustrated in FIGS. 1–14, a typical size valve 30 molded from silicone has two short slits 102 which are each 0.16 inch long, and has one elongate slit 100 which is 0.75 inch long. The overall length of the valve head 90, from the exterior surface of one end wall 78 to the exterior surface of the other end wall 78, is 0.852 inch. The overall width of the valve head 90, from the exterior surface of one sidewall 76 to the exterior surface of the other sidewall, is 0.232 inch. Along the slit 100, the depth of the slit is 0.019 inch. The radius of the valve head exterior concave surface 96 is 0.150 inch, and the concentric interior surface 92 has a radius of 0.200 inch. The thickness of each sidewall 76 and end wall 78 is 0.052 inch.

A lid or cover (not illustrated) may be provided over the closure body and valve. The cover may be attached with a hinge or tether, or the cover may be completely removable.

Figure 15:
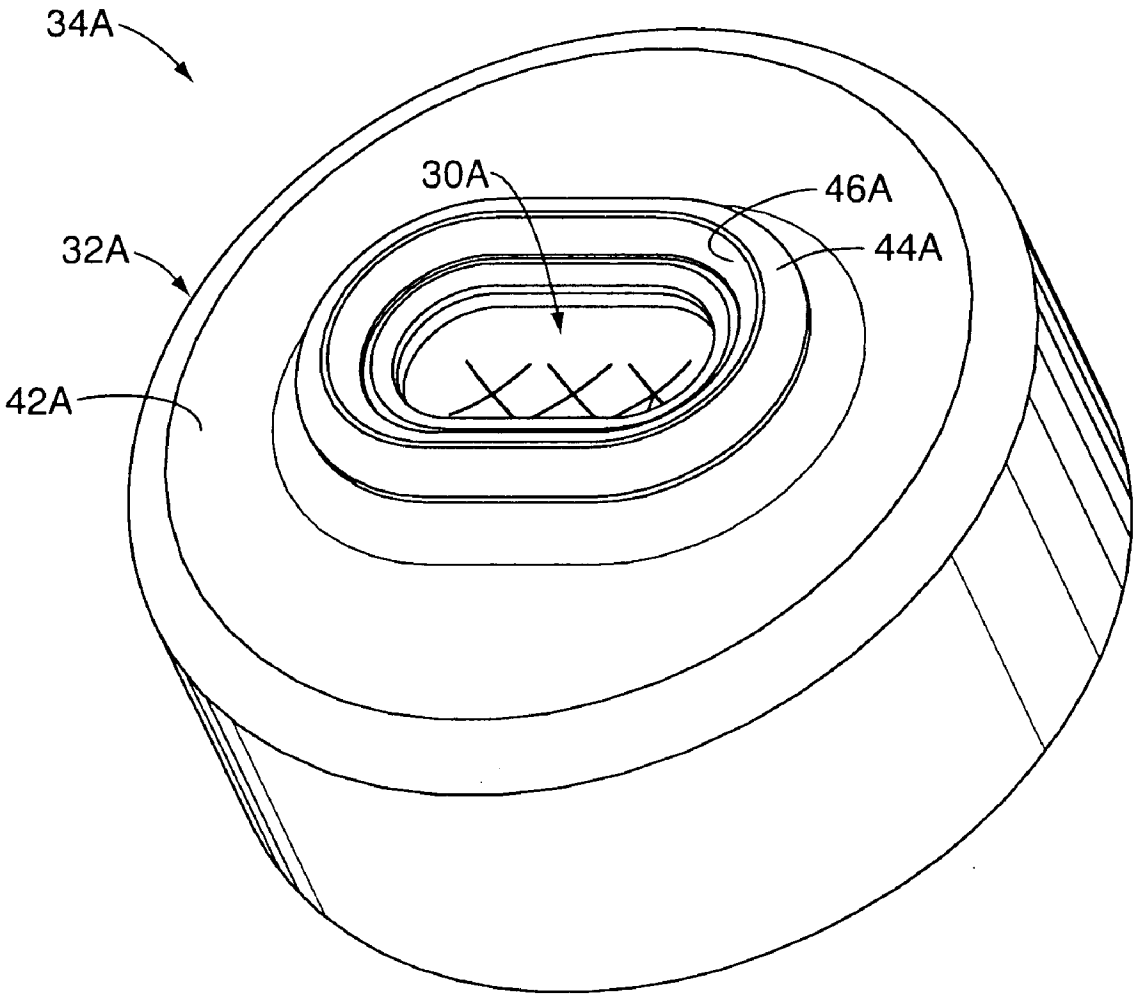
FIG. 15 is a perspective view showing a preferred, second embodiment of the closed, dispensing valve of the present invention in an optional arrangement where it is retained in, and forms part of, a separate closure that is adapted to be mounted on a container.
Figure 16:
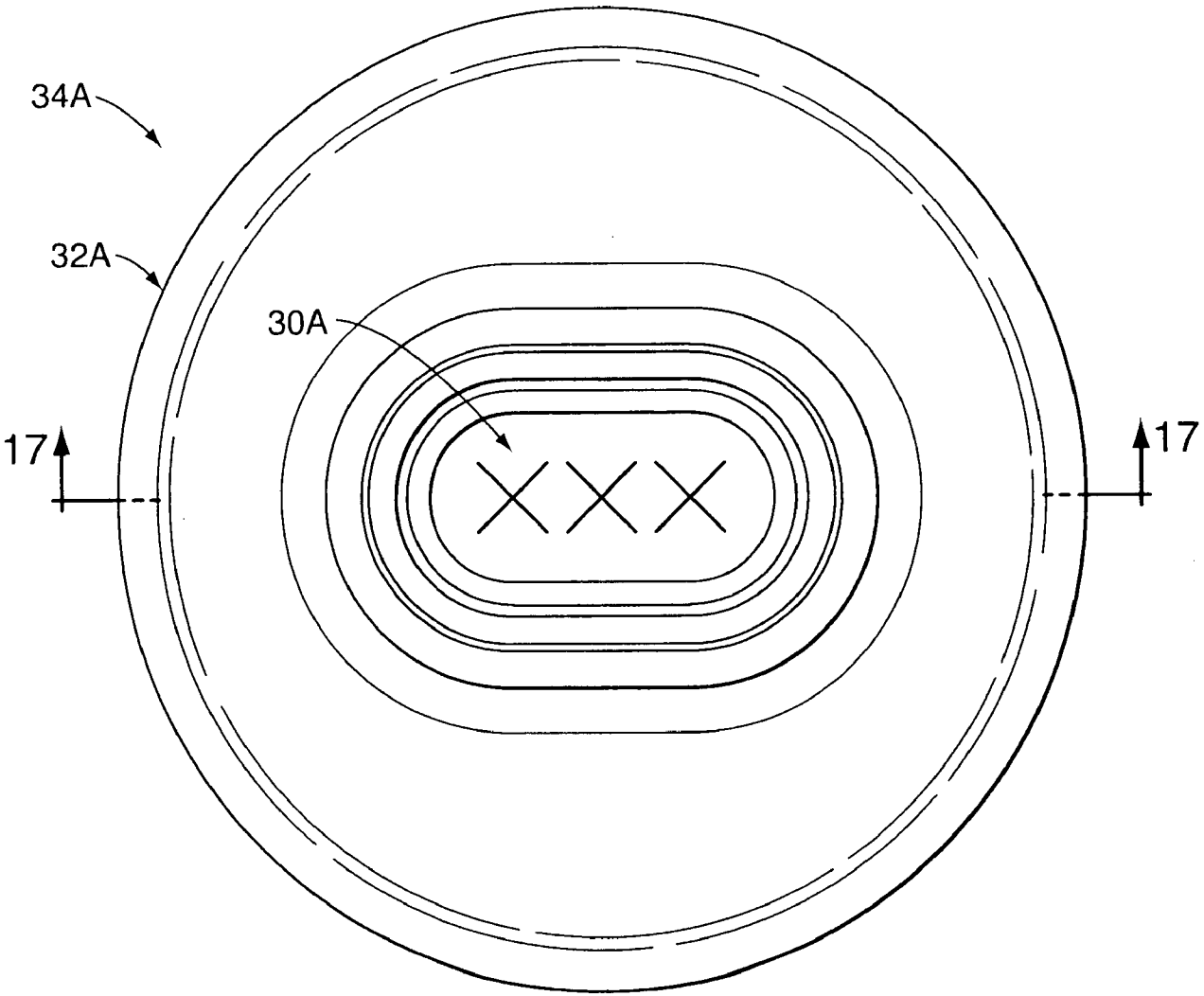
FIG. 16 is a top plan view of the closure shown in FIG. 15.
Figure 17:
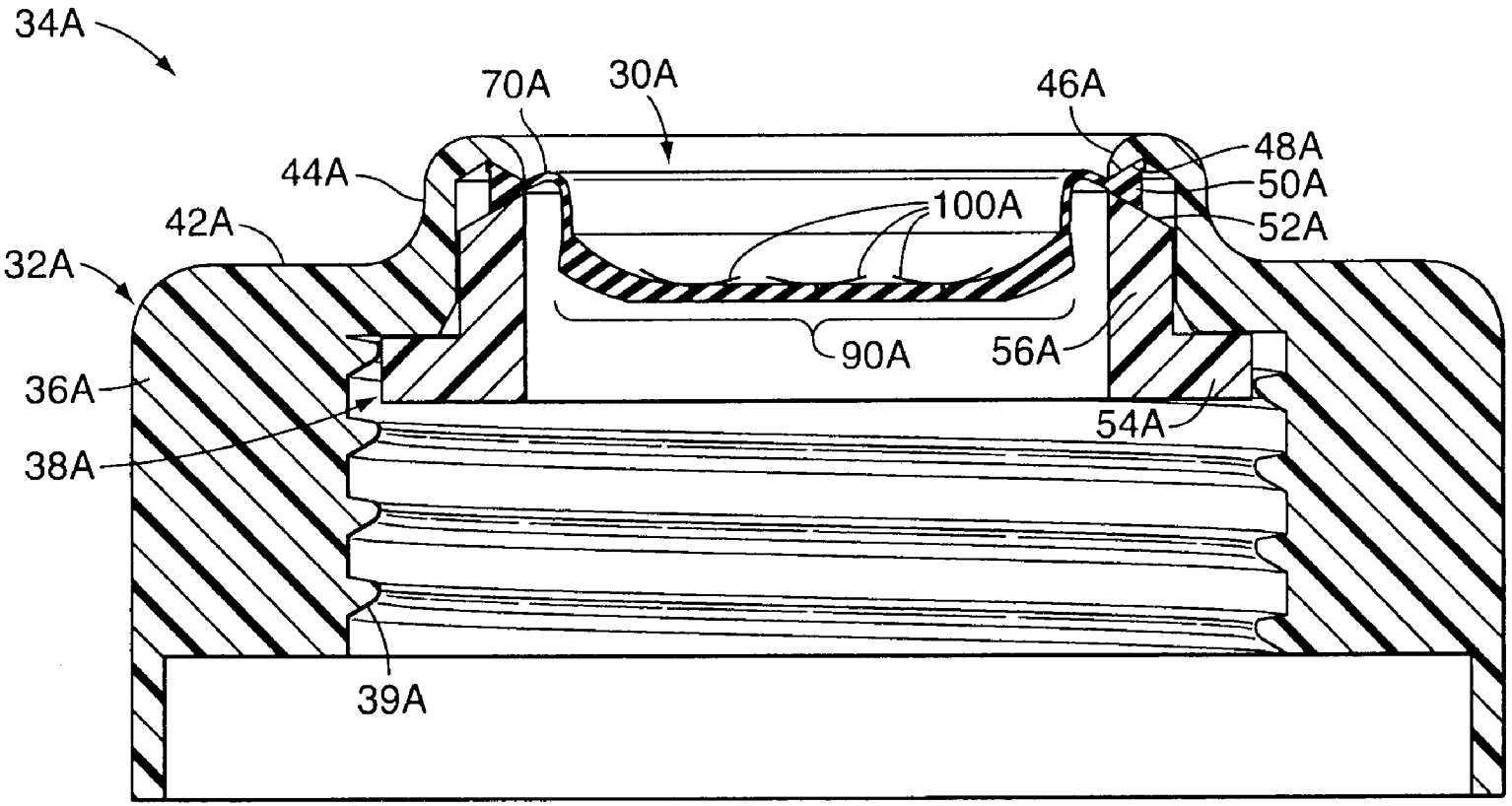
FIG. 17 is a cross-sectional view taken generally along the plane 17—17 in FIG. 16.

A preferred, second embodiment of the dispensing valve of the present invention is illustrated in FIGS. 15–24 and is designated generally therein with reference number 30A. The valve 30A is adapted to be mounted in a multi-piece housing 32A (FIGS. 15–17). Together, the valve 30A and housing 32A function as, and define, a dispensing closure designated generally by the reference number 34A in FIGS. 15–17.

The dispensing closure 34A, which is hereinafter sometimes referred to more simply as the "closure 34A," is provided as a separately manufactured unit or subassembly for mounting to the top of a container (not shown). It will be appreciated, however, that in some applications it may be desirable for the dispensing closure 34A to be formed as a unitary part, or extension, of the container wherein the unitary part or extension defines a dispensing end structure that is a part of the container per se.

The container (not shown) may have the same characteristics and uses as the container described above with respect to the first embodiment illustrated in FIGS. 1–14.

As shown in FIG. 17, the closure multi-piece housing 32A comprises a body 36A and an insert retainer 38A. The body 36A has a conventional internal thread 37A for engaging a mating container thread (not shown) to secure the closure body 36A to the container (not shown).

The closure body 36A and container could also be releasably connected with a snap-fit bead and groove (not illustrated), or by other means. Alternatively, the closure body 36A may be permanently attached to the container by means of induction bonding, ultrasonic bonding, gluing, or the like, depending upon the materials employed for the container and closure body 36A. Further, the closure body 36A could, in some applications, be formed as a unitary part, or extension, of the container.

The illustrated second form of the closure body 36A defines a radially inwardly extending, annular deck 42A (FIGS. 15 and 17). The interior of the body 36A may include special or conventional seal features (not illustrated) to provide a leak-tight seal between the closure body 36A and the container.

As can be seen in FIGS. 15 and 17, the body 36A includes a short spout-like formation 44A projecting upwardly from the body deck 42A. As can be seen in FIGS. 15 and 17, the spout-like formation 44A defines an aperture or opening 46A which has a generally elongate, rectangular shape with rounded corners. The body deck opening 46A is adapted to surround an upper portion of the valve 30A when the valve 30A is mounted within the closure body 36A as illustrated in FIGS. 15–17.

The interior of the closure body spout formation 44A adjacent the opening 46A defines a generally angled clamping surface 48A (FIG. 17) around the periphery of the opening 46A. The angled clamping surface 48 is adapted to engage a peripheral attachment portion, or flange, 50A of the valve 30A described in more detail hereinafter. The peripheral attachment portion 50A of the valve 30A is clamped against the closure body angled clamping surface 48A by the insert retainer 38A which, as shown in FIG. 17, defines an angled clamping surface 52A for engaging the valve flange 50A.

As illustrated in FIG. 17, the insert retainer 38A has a lower portion 54A and an upwardly extending upper portion 56A which defines the angled clamping surface 52A. As illustrated in FIG. 17, the lower portion 54A of the insert retainer 38A is adapted to be received within the closure body 36A below the closure body deck 42A. The insert retainer 38A may be held within the closure body 36A by suitable snap-fit engagement features (not illustrated) or by any other suitable permanent or releasable fixing means such as, for example, adhesive, ultrasonic bonding, a threaded connection, or the like. Typically, during assembly of the components of the closure 34A, the valve 30A is initially disposed within the closure body spout formation 44A adjacent the clamping surface 48A, and then the insert retainer 38A is inserted into the closure body 36A and fixed therein so as to clamp the valve 30A securely in place within the closure body 36A. The completed assembly of the insert retainer 38A and closure body 36A together may be characterized as the closure housing 32A. The two-piece closure housing 32A, together with the installed valve 30A, define the fully assembled, separate closure 34A.

In the preferred, second embodiment illustrated in FIGS. 15–24, the closure body 36A and insert retainer 38A are preferably molded from a suitable thermoplastic material such as polypropylene or the like. Other materials may be employed instead.

In other contemplated embodiments, the closure housing 32A need not be a multi-piece structure comprising the body 36A per se and retainer 38A per se. Further, the closure housing 32A need not be a structure that is completely separate from the container. Instead, the container per se could be made with a dispensing end structure that incorporates the insert retainer 38A as a unitary part of the container. Also, the closure body spout formation 44A could be initially provided as an upstanding, deformable, pre-form wall on the container distal end for being subsequently permanently deformed around the valve 30A after the valve 30A is positioned on the unitary container extension. This could be accomplished, for example, with an ultrasonic energy deformation process if the upstanding pre-form wall is molded as a unitary part of the container from a suitable thermoplastic material.

Alternatively, the spout formation 44A could be provided as a separate member which is subsequently attached by suitable releasable or permanent means to the upper end of the container over the valve flange 50A after the valve 30A has been appropriately mounted in position at the upper end of the container.

In any of the above-discussed alternatives, the container may have a bottom end (i.e., the end opposite the dispensing end in which the valve 30A is mounted), and that bottom end could be initially left open for accommodating the filling of the container with the product to be dispensed. After the container is filled with the product through the open bottom end of the container, the open bottom end of the container could be closed by suitable means, such as by a separate bottom end closure which could be attached to the container bottom end through a suitable threaded engagement, snap-fit engagement, adhesive engagement, thermal bonding engagement, etc. Alternatively, such an open bottom portion of the container could be squeezed closed with an appropriate heat and force applying process if the container bottom portion is made from a thermoplastic material or from other materials that would accommodate the use of such a process.

The valve 30A may be mounted via its peripheral attachment portion (i.e., flange) 50A within the other components of the closure 34A, or to some other dispensing structure, through which can be discharged a product from a supply of the product. The discharging product may be characterized as defining a flow direction from the valve into ambient atmosphere.

Figure 18:
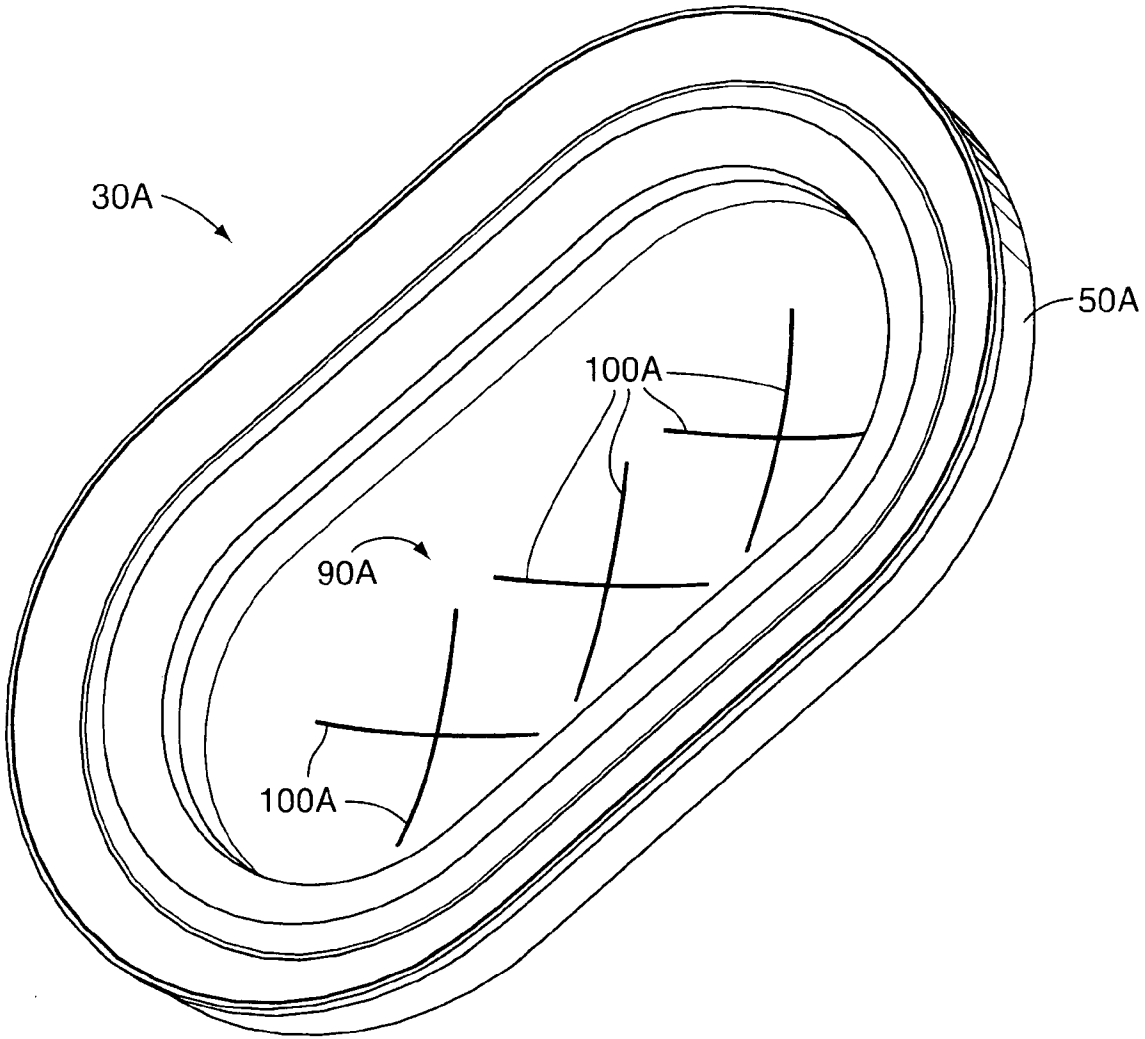
FIG. 18 is a perspective view of the valve alone in the closed condition as viewed from the exterior or top of the valve in the orientation that the valve would have if mounted in a closure on the top of a container.
Figure 19:
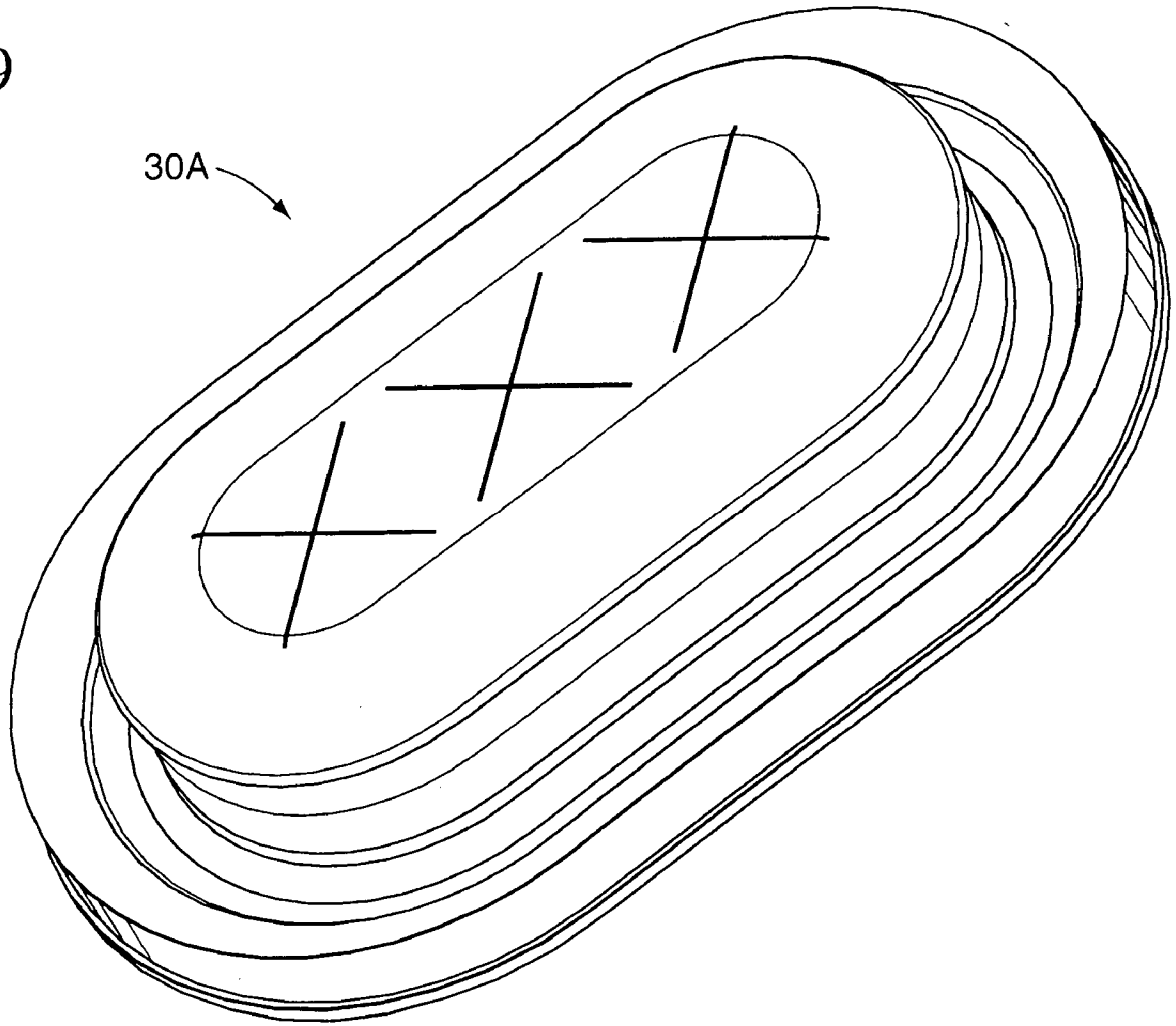
FIG. 19 is a view similar to FIG. 18, but FIG. 19 shows the bottom, interior, perspective view of the valve.
Figure 21:
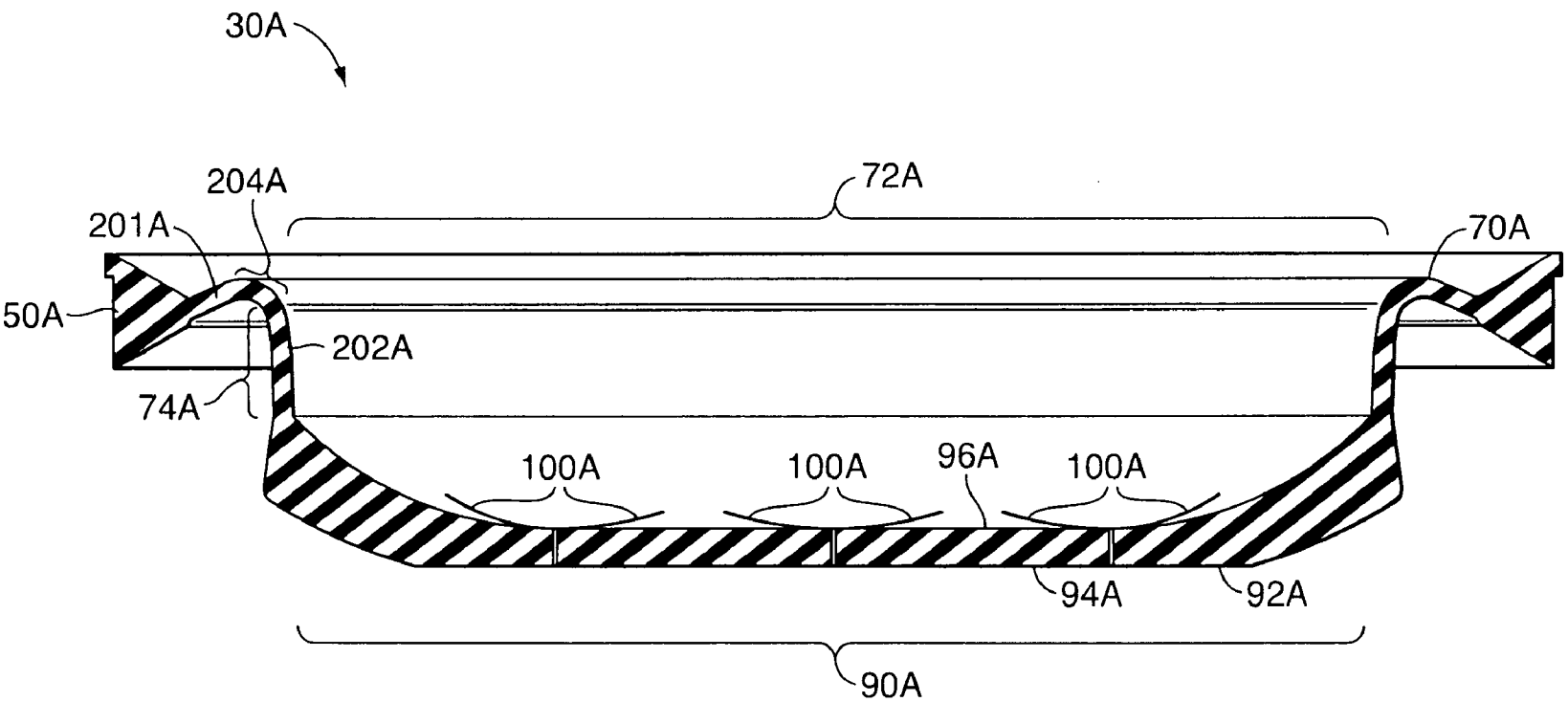
FIG. 21 is a cross-sectional view taken generally along the plane 21—21 in FIG. 20.
Figure 22:
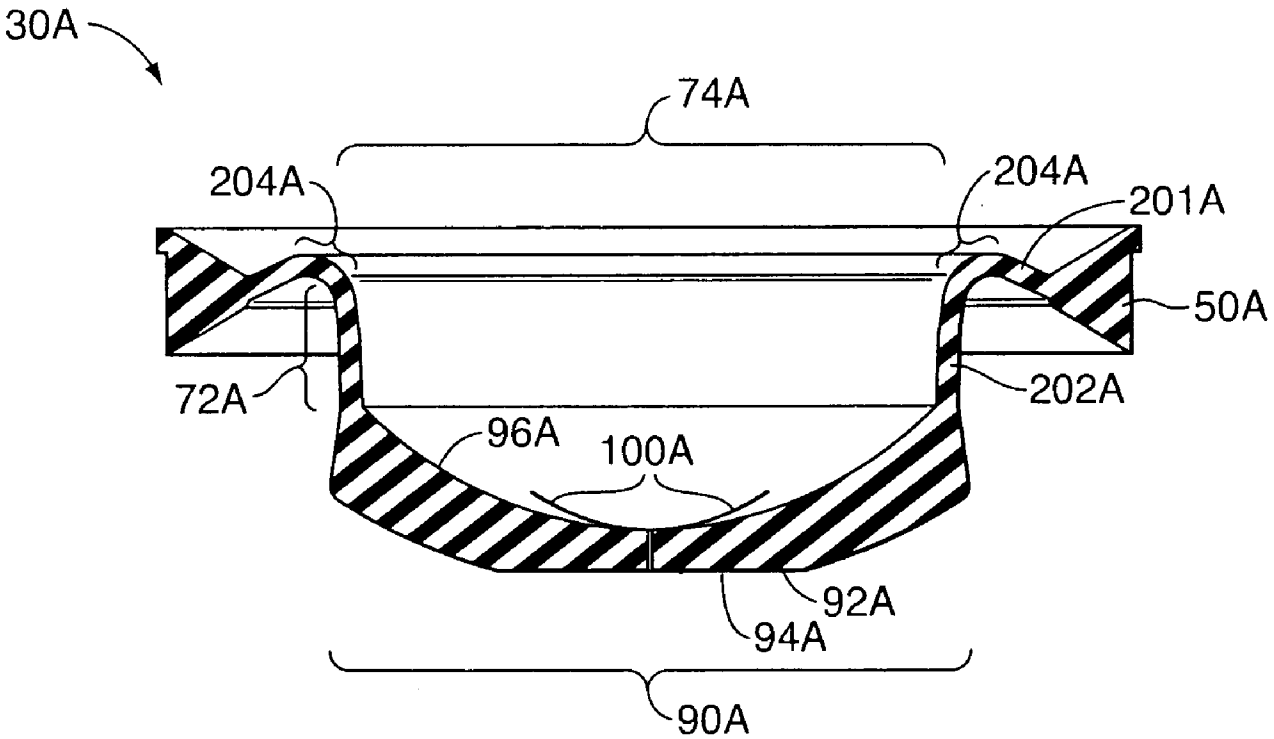
FIG. 22 is a cross-sectional view taken generally along the plane 22—22 in FIG. 20.

With reference to FIGS. 18, 21, and 22, the valve 30A includes the peripheral attachment portion which, in the preferred second form of the invention, is the flange 50A that has a generally dovetail cross-sectional configuration for being clamped between mating angled surfaces of the closure housing 32A (i.e., clamped between the closure clamping surface 48A (FIG. 17) on the top and the insert retainer clamping surface 52A on the bottom). This fixes the position of the valve attachment portion or flange 50A of the valve 30A relative to the container on which the closure 34A is mounted.

The valve 30A includes a flexible, peripheral sleeve 70A (FIG. 21) extending laterally and then downwardly (inwardly) from the peripheral attachment portion or flange 50A. When viewed from the ambient environment on the exterior side of the valve (FIG. 21), the sleeve 70A may be regarded as defining a hollow, central elongate portion 72A and two shorter end portions 74A at opposite ends of the elongate portion 72A.

The valve 30A includes a flexible, elongate head 90A as shown in FIGS. 18 and 21, and the head 90A extends from the lower (i.e., inner) region of the sleeve 70A. The head 90A is generally concave as viewed from the exterior of the valve 30A (see FIGS. 18 and 21). The valve head 90A has an interior surface 92A (FIG. 21) that interfaces with the interior volume of the container and that includes a central flat area 94A (FIG. 21). As shown in FIG. 21, the valve head 90A has an exterior surface 96A which interfaces with the ambient environment.

Figure 20:
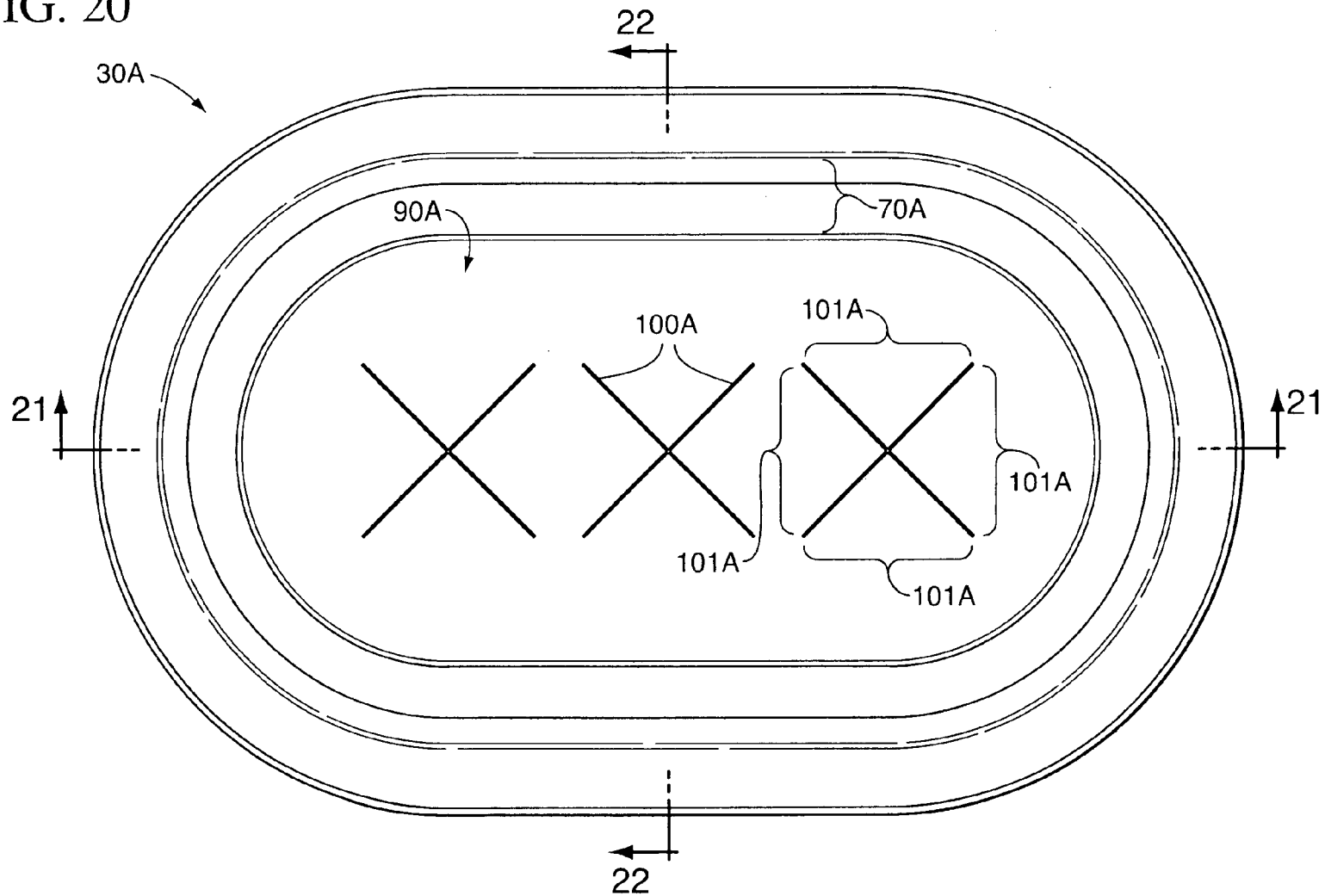
FIG. 20 is a top plan view of the valve shown in FIG. 18.

As shown in FIGS. 18 and 21, the valve head 90A includes two or more normally closed orifices (three illustrated) which are each defined by at least two elongate slits 100A which intersect or cross. As can be seen in FIG. 20, each slit 100A defines two, opposed, adjacent, elongate, movable, openable regions 101A which are normally closed. Each openable region 101A at a slit 100A has a transverse face through the thickness of the head 90A for sealing against the transverse face of the other opposed openable region 101A. When a sufficient pressure differential is applied to the valve head 90A, the valve head 90A moves outwardly and the slits 100A open as the valve head 90A deforms outwardly (as illustrated in FIG. 24) to permit the discharge of product therethrough.

Figure 23:
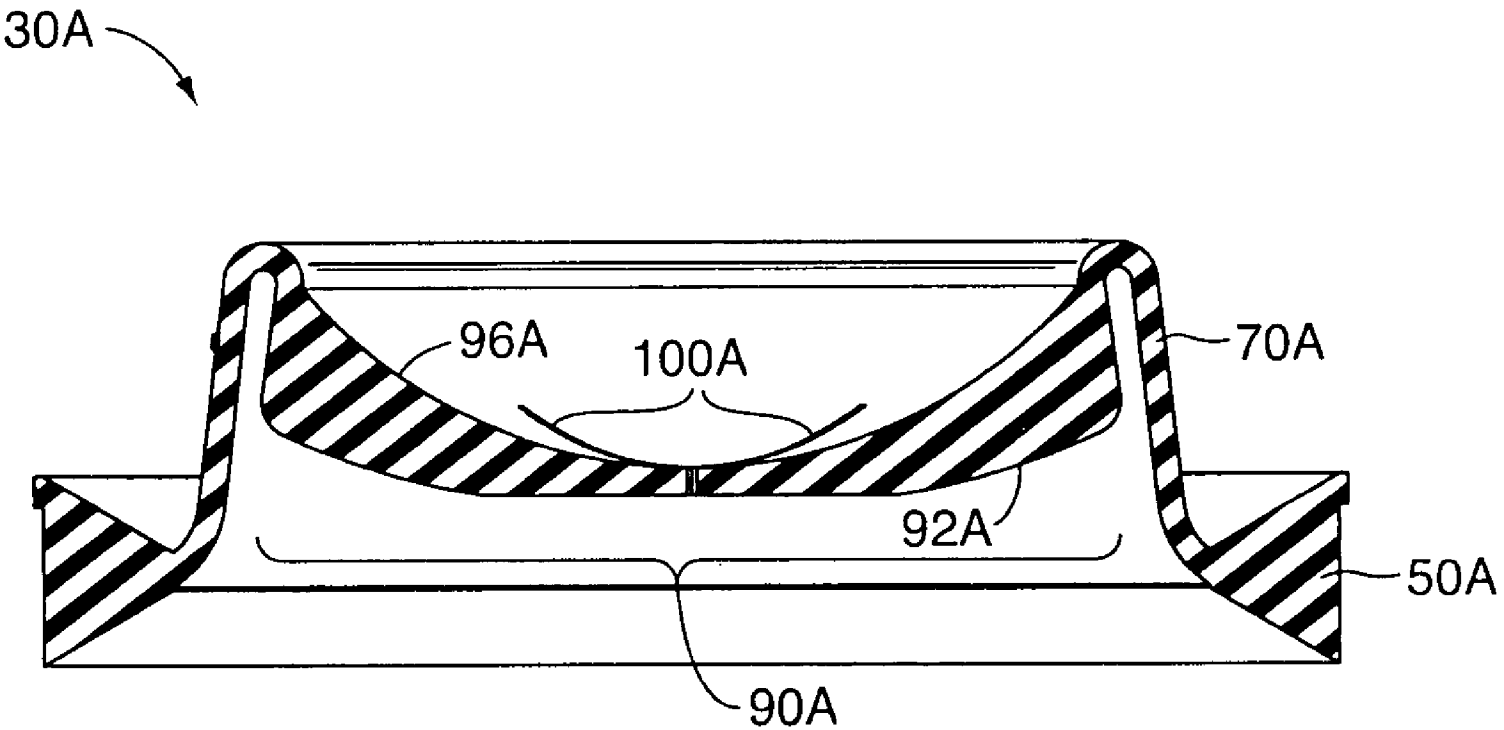
FIG. 23 is a view similar to FIG. 22, but FIG. 23 shows the valve subjected to a pressure differential which is acting across the valve and which has caused the valve sleeve and valve head to move outwardly relative to the valve flange.
Figure 24:
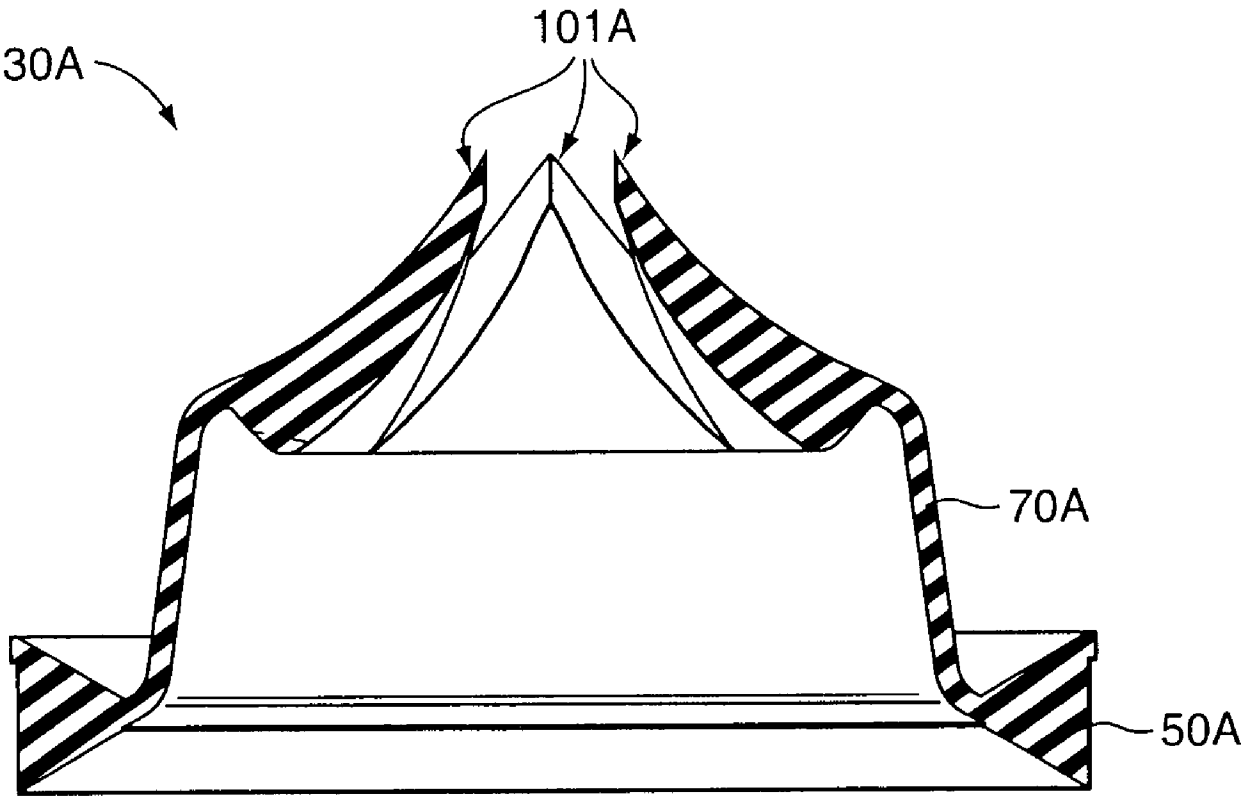
FIG. 24 is a view similar to FIG. 23, but FIG. 24 shows the valve subjected to greater differential pressure which has caused the sleeve and valve to move outwardly even further and has caused the valve head to open for dispensing product.

In the preferred, second embodiment illustrated in FIGS. 15–24, the two elongate slits 100A defining each normally closed orifice intersect to create four segment-shaped petals which define the movable, openable regions 101A. The triangular petal shape of each openable region 101A in the open condition is shown in FIG. 24. The petal-shaped openable regions 101A are each defined between the extending diverging portions of the intersecting elongate slits 100A.

It is to be realized that when the valve 30A is closed as shown in FIGS. 18 and 21, there is no slot or space between the opposing, openable regions 101A of the valve head 90A on either side of each slit 100A. That is, when the valve head 90A is closed, each slit 100A does not define any opening or passage between the two, opposed, elongate, openable regions 101A. Thus, the two opposed regions 101A at each slit 100A are in an abutting, sealing relationship when the valve 30A is in the closed condition.

In the preferred, second embodiment illustrated in FIGS. 15–24, each elongate slit 100A lies along an imaginary plane that (1) passes through the head 90A, and (2) is perpendicular to the head inner surface flat area 94A (FIG. 21). The transverse face of each opposed, openable region 101A lies along this imaginary plane (when the valve 30A is closed), and provides the sealing surfaces at the slit 100A.

In the illustrated preferred second embodiment valve 30A, the slits 100A extend laterally from a common origin define the four petals 101A (FIGS. 20 and 24) which flex outwardly substantially simultaneously to selectively permit the flow of product from a container through valve 30A. Each slit 100A terminates in a radially outer end. In the illustrated preferred second embodiment, the slits 100A are of equal length, although the slits could be of unequal length.

In the preferred second embodiment, each slit 100A is planar and is parallel to the general direction of product flow through the valve. Each slit 100A preferably defines a linear locus along the head portion exterior surface 92A and along the head portion interior surface 96A. Preferably, the slits 100A diverge from an origin and define equal size angles between each pair of adjacent slits 100A so that petals 101A are of equal size. Preferably, slits 100A diverge at 90° angles to define two mutually perpendicular portions of the intersecting slits. Slits 100A are preferably formed so that the opposing side faces of adjacent valve petals 101A closely seal against one another when the valve 30A is in its normal, fully closed position. The length and location of slits 100A can be adjusted to vary the predetermined opening pressure of valve 30A, as well as other dispensing characteristics.

As viewed in the short cross section through each pair of intersecting slits in FIG. 22, the valve exterior surface 96A lies on a circular arc. However, as viewed in the long transverse cross section through each pair of intersecting slits in FIG. 21, only the two end areas of the valve exterior surface 96A lie on a circular arc. As viewed in the transverse cross section in FIG. 21, each of the two end areas of the valve interior surface 92A beyond the flat area 94A lie along a circular arc. The circular arc surfaces on the exterior and interior of the head 90A of the valve 30A are not concentric in the illustrated preferred, second embodiment.

The valve 30A is preferably molded from an elastomer, such as a synthetic thermosetting polymer, including silicone rubber, such as the silicone rubber sold by Dow Corning Corp. in the United States of America under the trade designation DC 99-595HC. However, the valve 30A can also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

Owing to the unique configuration of the valve 30A, the valve 30A normally remains in the closed configuration shown in FIGS. 15–22 unless it is subjected to opening forces. The valve 30A can be moved to an open configuration (FIG. 24) by applying a sufficiently large pressure differential across the valve head 90A when the valve 30A is in the closed configuration so that the pressure acting on the exterior of the valve head 90A is lower than the pressure acting on the interior of the valve head 90A. Such a pressure differential forces the valve head regions or petals 101A outwardly to the open position (FIG. 24). The opening pressure differential can be achieved by pressurizing the interior of the container to which the closure 34A is mounted. Typically, the container would have a flexible wall which can be squeezed inwardly by the user to increase the pressure within the container. This preferably can be done while holding the container (with the closure 34A mounted thereon) in an inverted orientation so that the fluent material or other product within the container is squeezed and pressurized against the closed valve 30A. As the pressure moves the valve petals 101A to the open positions illustrated in FIG. 24, the material or product flows through the open slit 100A and past the open valve petals 101A.

The valve 30A could also be opened by a user sucking on the valve with sufficient force to lower the pressure on the valve head exterior surface below the internal pressure acting against the valve head interior surface.

The three pairs of intersecting slits 100A of the valve 30A open to discharge separate streams which may then merge into a single wide ("elongate"), discharge. This can be used to dispense a viscous fluent product in a wide, or ribbon-like, configuration. The discharge of product can be spread with the closure on a substrate or other target area. This closure is especially suitable for dispensing and spreading mayonnaise or peanut butter on bread, as well as for dispensing and spreading non-comestible materials.

If the container on which the closed valve 30A is mounted inadvertently tips over, the product does not flow out of the valve because the valve remains closed. Preferably, the valve 30A is designed to withstand the weight of the fluid on the inside of the valve 30A when the container is completely inverted. Preferably, the valve 30A is designed to open only after a sufficient amount of pressure differential acts across the valve—as when the user sucks on the end of the valve 30A and/or squeezes the container (if the container is not a rigid container).

With the preferred form of the valve 30A, if the differential pressure across the valve 30A decreases sufficiently, then the inherent resiliency of the valve will cause it to close. The valve 30A will then assume the closed position illustrated in FIGS. 15–22.

In one preferred embodiment, the petals 101A of the valve 30A open outwardly only when the valve head 90A is subjected to predetermined pressure differential or differentials acting in a gradient direction wherein the pressure on the valve head interior surface exceeds—by a predetermined amount—the local ambient pressure on the valve head exterior surface. The product can be dispensed through the open valve until the pressure differential drops below a predetermined amount, and the petals 101A close completely. If the valve 30A has been designed to be flexible enough to accommodate in-venting of ambient atmosphere, then the closing petals 101A can continue moving inwardly (not illustrated) to allow the valve 30A to open inwardly as the pressure differential gradient direction reverses and the pressure on the valve head exterior surface exceeds the pressure on the valve head interior surface by a predetermined amount.

For some dispensing applications, it may be desirable for the valve 30A to not only dispense the product, but also to accommodate such in-venting of the ambient atmosphere (e.g., so as to allow a squeezed container (on which the valve is mounted) to return to its original shape). The illustrated, preferred embodiment of the valve 30A has this capability. Such an in-venting capability can be provided by selecting an appropriate material for the valve construction, and by selecting an appropriate sleeve wall thickness, sleeve shape, head thickness, and head shape for the particular valve material and overall valve size. The degree of flexibility and resilience of the valve, and in particular, of the petals 101A, can be designed or established so that the petals 101A will deflect inwardly when subjected to a sufficient pressure differential that acts across the head and in a gradient direction that is reverse or opposite from the pressure differential gradient direction during product dispensing. Such a reverse pressure differential can be established when a user releases a squeezed, resilient container on which the valve is mounted. The resiliency of the container wall (or walls) will cause the wall to return toward the normal, larger volume configuration. The volume increase of the container interior will cause a temporary drop in the interior pressure. When the interior pressure drops sufficiently below the exterior ambient pressure, the pressure differential across the valve will be large enough to deflect the valve petals 101A inwardly to permit in-venting with the ambient atmosphere. In some cases, however, the desired rate or amount of in-venting may not occur until the squeezed container is returned to a substantially upright orientation that allows the product to flow under the influence of gravity away from the valve.

It is to be understood that valve dispensing orifices defined by the slits 100A may assume other different shapes, sizes, and/or configurations in accordance with the dispensing characteristics desired. For example, there may be three or more intersecting slits, particularly when larger or wider streams are desired, and/or the product is a particulate material or a liquid containing aggregates.

The connector sleeve or peripheral sleeve 70A is in the form of a rolling diaphragm that has a generally inverted J-shaped cross section and that has an interior surface and an exterior surface which merge with the valve head interior surface 92A and exterior surface 96A, respectively. The sleeve 70A has a first leg 201A (FIG. 21) that is connected with the attachment portion 50A of the valve 30A. The sleeve 70A has a second leg 202A (FIG. 21) that is connected with the head portion 90A of the valve 30A. The connector sleeve 70A may also be characterized as having a short, arcuate junction portion 204A (FIGS. 21 and 22) where the end of the short first leg 201A joins the adjacent end of the long second leg 202A. The first leg 201A is preferably shorter than the second leg 202A.

The thickness of each leg may vary along its length, and the thickness of the first leg 201A may be the same as, or different from, the thickness of the second leg 202A. However, in the illustrated preferred second embodiment, the first leg 201A and the second leg 202A are each of substantially uniform thickness. The thicknesses that could be employed depend on, among other things, the type of product to be dispensed, the material from which the valve is made, and the overall size of the valve.

In the preferred second embodiment shown in FIG. 21, the second leg 202A has a generally cylindrical, annular configuration that extends generally parallel to the product flow direction and that extends inwardly of the attachment portion 50A (i.e., downwardly from the attachment portion in FIG. 21). The connector sleeve 70A locates valve head 90A so that a horizontal plane passing through valve head 90A extends below (i.e., inwardly of) the marginal portion 50A. The term "horizontal plane" is used herein with reference to a vertically oriented dispensing valve 30A as shown in FIG. 17. Such a plane may also be characterized as a plane that is generally normal or perpendicular to the valve discharge flow path or direction.

The dispensing valve 30A is preferably configured for use in conjunction with a particular container, and a specific type of product, so as to achieve the exact dispensing characteristics desired. For example, the viscosity and density of the fluid product can both be important factors in designing the specific configuration of valve 30A for liquids. Other factors can include the shape, size, and strength of the container. The rigidity and durometer of the valve material, and size and shape of both valve head 90A and connector sleeve 70A, are also important in achieving the desired dispensing characteristics, and can be matched with both the container and the product to be dispensed therefrom.

The valve 30A is suitable for dispensing flowable products, such as liquids or even powder, particulates, or granular material, as well as suspensions of solid particles in a liquid. However, the elongate shape of the valve 30A makes it particularly suitable for dispensing a product over a wide target area, and the valve 30A is especially suitable for dispensing a spreadable product, such as mayonnaise, in a multi-stream or ribbon-like configuration.

In operation, the valve 30A in the closure 34A functions in the following manner. The valve 30A normally assumes an initial, inwardly protruding orientation illustrated in FIG. 17, wherein the valve 30A remains substantially in its original molded shape without deformation (i.e., the connector sleeve 70A is substantially unstressed, and the discharge slits 100A are fully closed). When the valve 30A is mounted in a closure 34A at the top of a container, as is shown in FIG. 17, the valve 30A is configured such that discharge slits 100A will remain securely closed after the container is inverted, even under the hydraulic head pressure applied to the valve 30A by a fluid product when the inverted container is completely full.

When additional pressure is established in the interior of the container, such as by manually flexing the container sidewalls inwardly, connector sleeve 70A begins to distort, and the valve head 90A begins to shift axially outwardly.

As the interior of the container is subjected to additional pressure, the valve head 90A continues to move outwardly, and the sleeve 70A doubles over and moves rollingly outwardly until the connector sleeve 70A is substantially fully extended as illustrated in FIG. 23. When the valve head 90A is in the substantially fully extended position (FIG. 23), the connector sleeve 90A is highly stressed.

When the interior of the container is subjected to further increased pressure, the valve head 90A continues to shift slightly further outwardly. However, because the connector sleeve 70A is already substantially fully extended, it is believed that further outward shifting of the valve head 90A longitudinally tensions or stretches the connector sleeve 70A, thereby increasing outwardly directed torque applied to the valve head 90A. Also, the further outward movement of the valve head 90A tends to flatten or straighten the valve head 90A, particularly along the exterior surface 96A thereof. This flattening motion tends to slightly enlarge or dilate the plan configuration of the valve head 90A, which enlargement is in turn resisted by laterally inwardly directed forces applied to the marginal portions of the valve head 90A by the connector sleeve 70A, thereby generating another complex pattern of stresses within the valve 30A, and these include stresses which tend to compress the valve head 90A in a laterally inward direction. The majority of compression strain is believed to take place adjacent the central portion of the valve head 90A.

When additional pressure is applied to the interior of the container, the valve head 90A continues to shift outwardly by further longitudinal stretching of the connector sleeve 70A, and further enlargement of the plan shape of the valve head 90A. The inventors believe that the valve head 90A becomes more stressed and elastically deformed as a consequence of the increased torque applied thereto by the connector sleeve 70A. The combined forces, torques, and movements appear to also further place the valve head 90A into a state of bifurcation, wherein the combined forces acting on the valve head 90A will, upon application of any additional outward pressure on the interior side 92A of the valve 30A, cause the valve 30A to quickly open outwardly by separating the valve flaps 101A in the manner illustrated in FIG. 24, and this permits the product to be dispensed through the open valve.

The above-discussed "state of bifurcation" refers to the relatively unstable condition that the valve 30A assumes immediately prior to the valve flaps 101A starting to open. As the valve 30A passes through the bifurcation state, the combined forces acting on the valve head 90A are in a temporary, unstable condition of equilibrium, and then quickly shift the valve head 90A into a generally convex shape, simultaneously opening the valve flaps 101A to create the product discharge openings.

It will be appreciated that while various theories and explanations have been set forth herein with respect to how forces, torques, movements, and stresses may effect the operation of the valve of the present invention, there is no intention to be bound by such theories and explanations. Further, it is intended that valve structures falling within the scope of the appended claims are not to be otherwise excluded from the scope of the claims merely because the operation of such valve structures may not be accounted for by the explanations and theories presented herein.

The design of the connector sleeve 70A preferably is such that at least part of the head 90A of the open valve 30A extends outwardly of the closure 34A so as to permit better observation by the user.

The thickness of the valve head 90A and sleeve 70A, and the length of the valve slits 100A can be selected so that the open valve either snaps closed when the pressure differential decreases to a predetermined level or remains fully open even when the pressure differential drops to zero.

If the valve 30A is designed to close after dispensing, then the valve 30A may be made flexible enough so that the valve flaps 101A can also open inwardly to accommodate inventing as described above.

Figure 25:
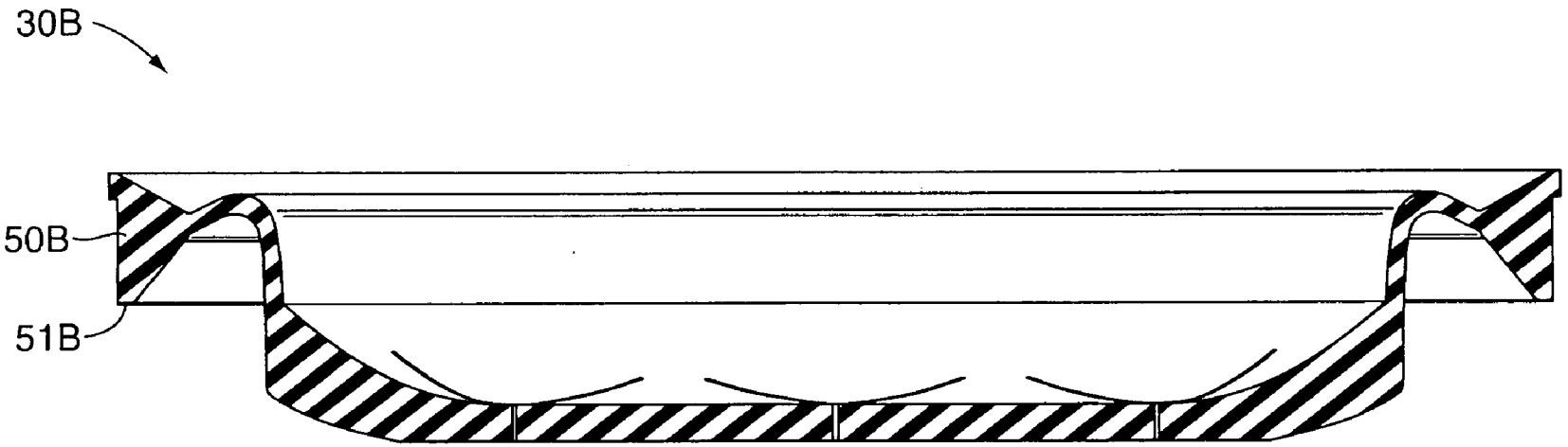
FIG. 25 is a cross-sectional view similar to FIG. 21, but FIG. 25 shows a preferred, third embodiment of the valve wherein the valve flange has a slightly different configuration for being clamped in a closure or other structure.

A third embodiment of the valve of the present invention is illustrated in FIG. 25 and is designated generally therein by the reference number 30B. The valve 30B is identical with the second embodiment valve 30A described above with reference to FIGS. 15–24 except that the third embodiment valve 30B has a slightly different attachment portion or flange 50B. Specifically, the flange 50B has a narrow, flat land 51B on the bottom. In contrast, the second embodiment valve 30A has a relatively sharp edge instead of a land. In all other respects the third embodiment valve 30B has the same structure as the second embodiment valve 30A and functions in the same manner to discharge product as the second embodiment valve 30A. The land 51B on the third embodiment valve 30B is useful with some types of retention or clamping features of particular dispensing closures or other dispensing structures for which the valve 30B is intended.

Figure 26:
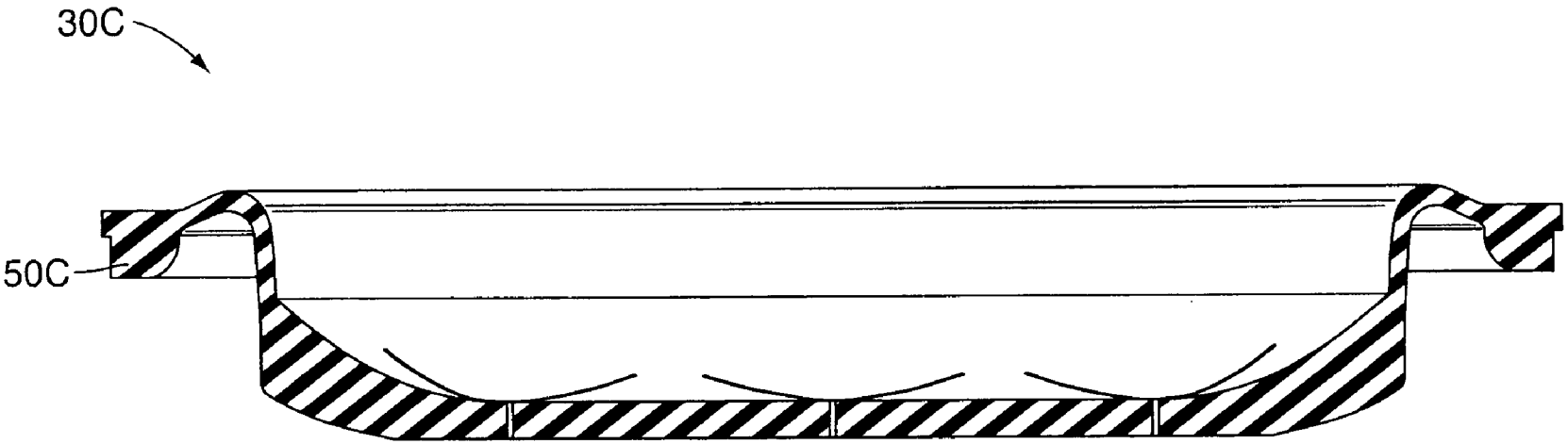
FIG. 26 is a view similar to FIG. 25, but FIG. 26 shows a preferred, fourth embodiment of the valve with a modified valve flange for accommodating heat sealing of a flange to a closure or other structure.

FIG. 26 illustrates a fourth embodiment of the valve of the present invention, and in FIG. 26 the fourth embodiment of the valve is generally designated by the reference number 30C. The fourth embodiment valve 30C is substantially identical with the second embodiment valve 30A discussed above with reference to FIGS. 15–24, except that the fourth embodiment valve 30C has a differently shaped flange or attachment portion 50C. The flange 50C is particularly suitable for heat sealing of the valve flange to a dispensing structure, such as a closure in which the valve is mounted. The flange 50C, rather than having a dove-tail shape cross section, instead has a generally square cross section with a rounded lower inner corner. In all other respects, the fourth embodiment valve 30C functions to discharge product in the same way as the second embodiment valve 30A.

Figure 27:
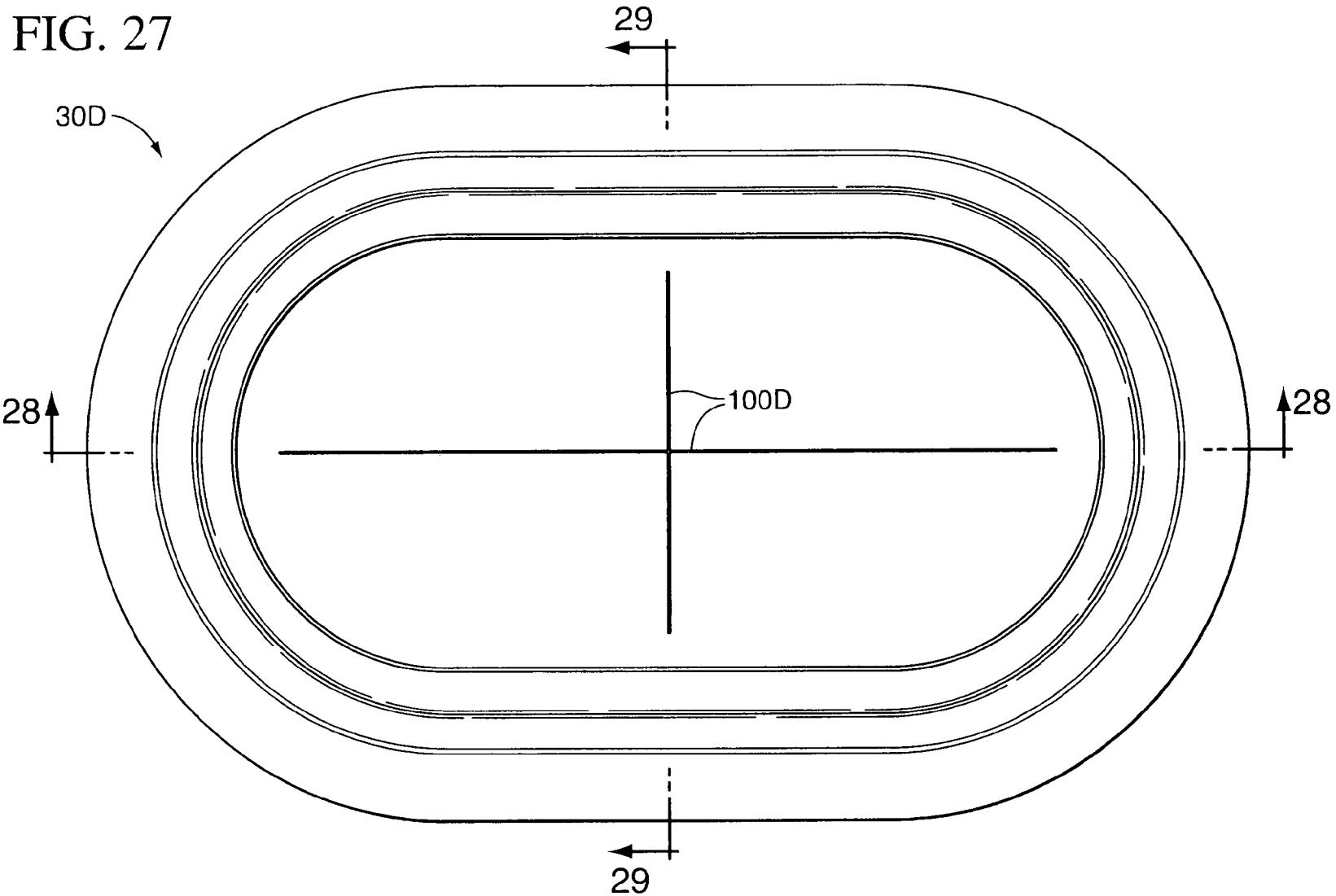
FIG. 27 is a top, plan view of a preferred, fifth embodiment of the closed, dispensing valve of the present invention wherein the valve has only one, normally closed orifice defined by a single pair of intersecting or crossing slits.
Figure 28:
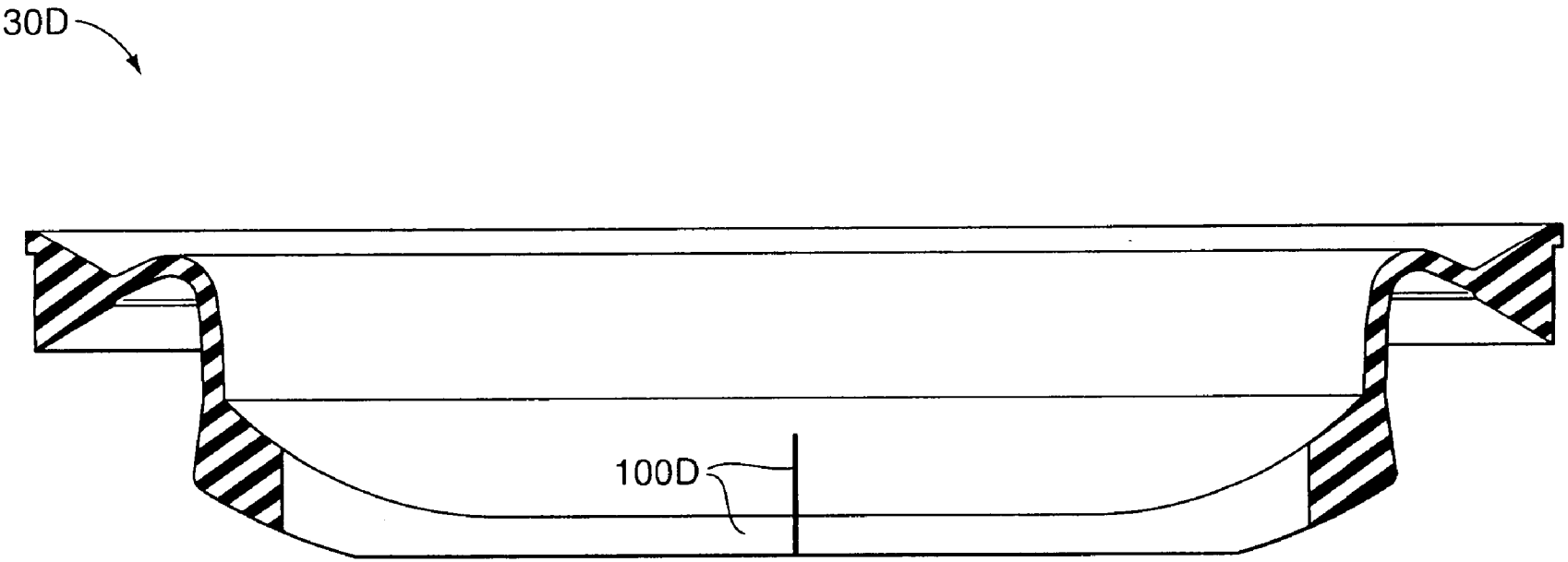
FIG. 28 is a cross-sectional view taken generally along the plane 27—27 in FIG. 27.
Figure 29:
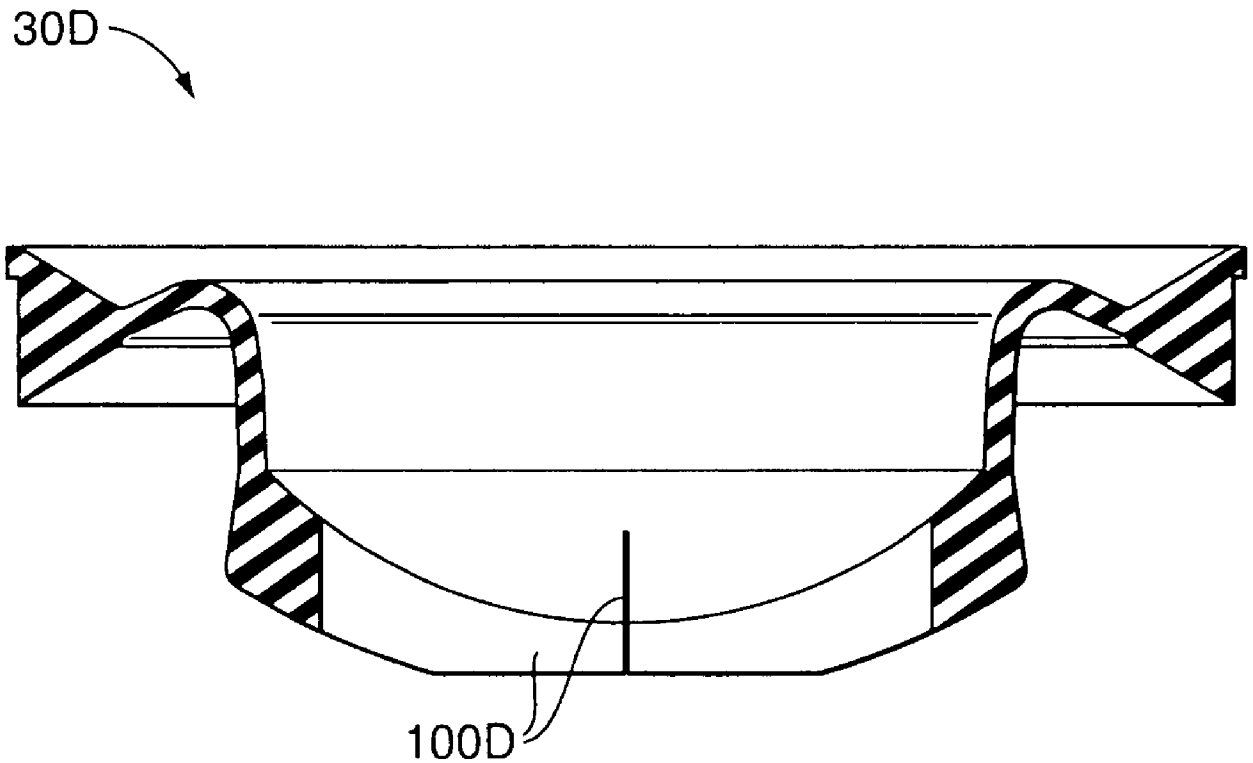
FIG. 29 is cross-sectional view taken generally along the plane 29—29 in FIG. 27.

A fifth embodiment of the valve of the present invention is illustrated in FIGS. 27–29 and is generally designated therein by the reference number 30D. The fifth embodiment valve 30D is substantially identical with the second embodiment valve 30A described above with reference to FIGS. 15–24, except that the fifth embodiment valve 30D has only one pair of cross slits 100D instead of three pairs. Further, the two cross slits 100D in the fifth embodiment valve 30D are oriented so that one of the slits 100D lies along the lengthwise longitudinal axis of the elongate valve 30D and so that the other of the intersecting slits 100D lies along the short, crosswise axis of the valve. The crosswise slit 100D is shorter than the lengthwise slit 100D as can be clearly seen in FIGS. 27 and 28.

The fifth embodiment valve 30D functions to discharge product in generally the same way that product is discharged by the second embodiment valve 30A. However, with the fifth embodiment valve 30D, the product may tend to be discharged more heavily or thickly at the center portion of the valve 30D (where the two slits intersect) than at the lateral end portions of the valve. In contrast, the second embodiment valve 30A, with its three pairs of slits, may tend to provide a more uniform discharge of product along the length of the valve compared to the fifth embodiment valve 30D. An even greater uniformity of the thickness of discharging product from the elongate second embodiment valve 30A could be achieved by providing more than three pairs of slits in the row, and/or by locating the pairs of slits closer together.

Of course, the first embodiment valve 30 described above with reference to FIGS. 1–14 should generally operate to dispense the most uniform discharge of product in a ribbon-like configuration compared to the second, third, fourth, and fifth embodiment valves. Nevertheless, depending upon the viscosity of the discharging product, the size of the valve, the length of the slits, the thickness of the valve material, etc., the differences in uniformity of product discharge from the different valve embodiments may be negligible.

Although the valves of the present invention are especially suitable for dispensing a ribbon of spreadable product onto a substrate, the valves are also ergonomically suitable for dispensing directly into the mouth of the user.

It will also be appreciated that the second, third, and fourth valve embodiments 30A, 30B, and 30C, respectively, can be modified as necessary for dispensing discrete, separated, multiple streams that do not form a single wide ribbon.

Specifically, the pairs of intersecting slits could be spaced apart by greater distances. Depending upon the viscosity of the product and the spacing between pairs of intersecting slits, the multiple pairs of intersecting slits can be arranged so that the product discharging out of each pair of slits is relatively far from the product discharging out of the adjacent pairs of slits whereby a plurality of separate, discrete streams are dispensed outwardly without coalescing or touching to form a single, wide ribbon of discharging product.

The invention contemplates other modifications which can be readily made to the second, third, fourth, and fifth embodiments 30A, 30B, 30C, and 30D, respectively, for affecting the direction of the discharge of the product from an intersecting slit orifice. The modification involves varying the thickness of a portion or portions of the valve head so that at least one portion of the valve head is considerably thinner than another portion or portions of the valve head. The valve head could be made thinner next to one of the intersecting slit orifices so that when the valve head is subjected to a pressure differential, the valve head is non-uniformly forced outwardly such that the thinner portion of the valve head is forced further outwardly than the thicker portion or portions. If the valve head is thinner adjacent one of the slit orifices, and if the differential pressure causes that thinner portion to be forced further outwardly than adjacent thicker portions, then part of the thinner portion will slope from a further outwardly location toward the more inwardly thicker portion. If one or more of the intersecting slit orifices is located on the slanting portion, then the discharge direction or angle of flow from such an orifice will be angled or oblique relative to the discharge from the other slit orifices in the thicker portion or portions of the valve head.

The slit orifices in the thicker portion or portions of the valve head would typically discharge product in generally parallel flow streams generally along the main flow direction from the valve. However, a slit orifice on the slanted part of a thinner portion of a pressurized valve head would be directed at an angle relative to the general discharge direction of the other slit orifices in the valve head thicker portions.

For example, with reference to the second embodiment of the valve 30A illustrated in FIG. 15, there are three pairs of intersecting slit orifices. The head of the valve 30A could be made thinner in the middle portion where the middle intersecting slit orifice is defined, and the valve head could be made thicker at each lateral end just beyond each of the two outer intersecting slit orifices. Then, when a differential pressure is applied across the valve head, the thinner central portion of the valve head (containing the central slit orifice) would be forced outwardly (bulge outwardly) more than the thicker lateral ends of the valve. This would cause the two outermost intersecting slit orifices to lie along a slope or angle on each side of the central bulge. The two outermost slit orifices would then each be generally oriented so as to direct their discharging flow at an angle somewhat laterally toward the side instead of straight out and parallel to the discharging stream of the center slit orifice.

By such variation in the thickness of a portion or portions of the valve head, an intersecting slit orifice or orifices can be designed to open and discharge at an angle relative to some of other intersecting slit orifices. Such a variation in valve head thickness could be used even with just one intersecting slit orifice to cause the orifice to discharge at an angle relative to a general geometric axis through the valve and/or dispensing structure containing the valve.

It is contemplated that, according to another, optional aspect of the present invention, the valve, or at least the flexible, elongate head of the valve, may be generally oval. That is, the valve head, or even the whole valve, may have a plan configuration in the shape of an oval with a major and minor axis, but without straight side portions per se (e.g., without straight side portions 76 for the first embodiment 30 illustrated in FIG. 6). According to this optional aspect of the invention, all of the embodiments of the valve 30, 30A, 30B, 30C, and 30D could also be provided with curved side portions rather than the generally straight side portions illustrated.

It will also be appreciated that the valve head need not be symmetrical in plan view (i.e., as the symmetry is viewed for the embodiments illustrated in FIG. 6, FIG. 20, and FIG. 30D). For example, one side may extend laterally outwardly more than the opposite side.

It has been noted above that the valve of the present invention may be employed with a variety of dispensing structures, including various types of dispensing closures which can be mounted on a container or other device or system in which product is contained and from which the product is to be dispensed through the valve. Such a closure may retain the valve by any suitable means. In the embodiments illustrated in the drawings, the valve is shown retained in a closure body with the use of a retaining member which acts with the closure body to hold the valve in position (e.g., retainer 38 for the first embodiment of the valve 30 illustrated in FIG. 3 or retainer 38A for the second embodiment illustrated in FIG. 17). The retainers 38 and 38A are inserted into the bottom of the closure to clamp the valve against a downwardly facing clamping surface defined on the inside of the valve body. It will be appreciated that the valve may instead be retained in a closure of a different design wherein the valve is inserted through the top of the closure body against an outwardly facing surface in the closure body, and wherein the valve is then retained on the closure body by a retainer inserted through the top of the closure body to clamp the valve against the closure body. Such a "top insertion" arrangement can be readily designed for the embodiments of the valve illustrated in the drawings and for other variations of the valve.

Of course, completely different means for retaining a valve in a closure or dispensing structure may be employed. For example, the valve may be bi-injection molded directly to a dispensing structure or other component, or the valve may be adhesively secured to such a component, or the valve may be clamped to such a component by deforming a wall of the component against a peripheral portion of the valve, etc.

The valve of the present invention, including all five of the illustrated embodiments, may be used on a structure other than a container per se. The valve may be used, for example, in a fluid processing system, dispensing machine, medical apparatus, etc.

It will be readily observed from the foregoing detailed description of the invention and from the illustrations thereof that numerous other variations and modifications may be effected without departing from the true spirit and scope of the novel concepts or principles of this invention.

What is claimed is:

1. A self-sealing, dispensing valve comprising:

(A) a peripheral sleeve that surrounds an interior volume and that has (1) a central elongate portion that includes two spaced-apart elongate sidewalls each having an upper region and a lower region; and (2) two shorter end portions that each (a) define an end wall joining said sidewalls, and (b) have an upper region and a lower region;

(B) a peripheral attachment portion extending from said lower regions of said sidewalls and end walls by which said valve may be attached to a dispensing structure through which can be discharged a product from a supply of said product; and (C) a flexible, elongate head extending from said upper regions of said sidewalls and end walls, said head being generally concave as viewed from the exterior of said valve relative to said interior volume, said head having (1) an interior surface that interfaces with said interior volume, and (2) a curving exterior surface interfacing with the ambient environment, said head including a long slit and two spaced-apart, short slits; each of said short slits being (1) generally perpendicular to said long slit, (2) located at an end of said long slit, and (3) in communication with said long slit so as to define two, opposed, elongate petals wherein (a) each said petal has a long edge and two short edges, and (b) said petals are normally closed, but open outwardly to permit the discharge of said product through the valve in response to a pressure differential across said head in one pressure gradient direction, and open inwardly to permit the in-venting of ambient atmosphere through the valve in response to a pressure differential across said head in the opposite pressure gradient direction.

2. The valve in accordance with claim 1 in which said valve is adapted to be attached to a dispensing end structure that comprises a separate closure for being releasably or permanently mounted to a container.

3. The valve in accordance with claim 1 in which said peripheral attachment portion is a laterally outwardly extending flange.

4. The valve in accordance with claim 1 in which (1) said interior surface includes a flat area, and (2) said elongate slit lies along an imaginary plane that (a) passes through said head, and (b) is perpendicular to said head interior surface flat area.

5. The valve in accordance with claim 1 in which each said end wall includes a straight section between two curved sections which each joins one of said sidewalls.

6. The valve in accordance with claim 1 in which the length of each said sidewall is at least three times the width of said valve head.

7. The valve in accordance with claim 1 in which said valve is included in combination with a separate housing that retains said valve and that is adapted for being releasably or permanently mounted to said container, said housing including a support wall adjacent each said elongate sidewall in said interior volume for preventing each said sidewall from collapsing beyond said support wall.

8. The valve in accordance with claim 1 in which said valve head petals each is thinner along said elongate slit than at locations away from said elongate slit.

9. A self-sealing, dispensing valve comprising:

a peripheral attachment portion by which said valve may be attached to a dispensing structure through which can be discharged a product from a supply of said product such that the discharging product generally defines a flow direction from said valve into the ambient environment;

a flexible, peripheral sleeve extending from said peripheral attachment portion, at least part of said sleeve extending generally parallel to said flow direction to a location either outwardly or inwardly of said peripheral attachment portion, said sleeve, when viewed from the ambient environment, has a plan view configuration comprising a central elongate portion and two shorter end portions at opposite ends of said central elongate portion; and a flexible, elongate head extending generally laterally from said peripheral sleeve, said head having a thickness and including at least one elongate slit through said thickness defining two, opposed openable regions in said head which (1) each has at least one transverse face for sealing against a transverse face of said other openable region, (2) are normally closed but open to permit the discharge of said product therethrough in response to a pressure differential across said head and (3) the thickness of each of said valve head openable regions adjacent said slit is at least equal to the depth of said slit through said valve head openable regions.

10. The valve in accordance with claim 9 in which (1) said peripheral attachment portion is a laterally extending flange; and (2) said valve is adapted to be attached via said flange to a dispensing end structure that comprises a separate closure for being releasably or permanently mounted to a container.

11. The valve in accordance with claim 9 in which said at least part of said sleeve extends in the flow direction to a location outwardly of said peripheral attachment portion.

12. The valve in accordance with claim 9 in which said central elongate portion of said peripheral sleeve includes two spaced-apart elongate sidewalls;

said two shorter end portions of said peripheral sleeve each comprises an end wall joining said sidewalls; and each said end wall includes a straight section between two curved sections which each joins one of said sidewalls.

13. The valve in accordance with claim 12 in which the length of each sidewall is at least three times the width of said valve head.

14. A self-sealing, dispensing valve comprising:

a peripheral attachment portion by which said valve may be attached to a dispensing structure through which can be discharged a product from a supply of said product such that the discharging product generally defines a flow direction from said valve into the ambient environment;

a flexible, peripheral sleeve extending from said peripheral attachment portion, at least part of said sleeve extending generally parallel to said flow direction to a location either outwardly or inwardly of said peripheral attachment portion, said sleeve, when viewed from the ambient environment, has a plan view configuration comprising a central elongate portion and two shorter end portions at opposite ends of said central elongate portion; and a flexible, elongate head extending generally laterally from said peripheral sleeve, said head having a thickness and including at least one elongate slit through said thickness defining two, opposed openable regions in said head which (1) each has at least one transverse face for sealing against a transverse face of said other openable region, and (2) are normally closed but open to permit the discharge of said product therethrough in response to a pressure differential across said head, and wherein said at least part of said sleeve extends opposite the flow direction to a location that is both laterally inwardly of said peripheral attachment portion and upstream of said peripheral attachment portion.

15. A self-sealing, dispensing valve comprising:

a peripheral attachment portion by which said valve may be attached to a dispensing structure through which can be discharged a product from a supply of said product such that the discharging product generally defines a flow direction from said valve into the ambient environment;

a flexible, peripheral sleeve extending from said peripheral attachment portion, at least part of said sleeve extending generally parallel to said flow direction to a location either outwardly or inwardly of said peripheral attachment portion, said sleeve, when viewed from the ambient environment, has a plan view configuration comprising a central elongate portion and two shorter end portions at opposite ends of said central elongate portion; and a flexible, elongate head extending generally laterally from said peripheral sleeve, said head having a thickness and including at least one elongate slit through said thickness defining two, opposed openable regions in said head which (1) each has at least one transverse face for sealing against a transverse face of said other openable region, and (2) are normally closed but open to permit the discharge of said product therethrough in response to a pressure differential across said head, and wherein (a) said head is generally concave when the valve head openable regions are closed as viewed from the exterior ambient environment when said valve is attached to a dispensing structure; and (b) the periphery of said valve head extends outwardly further than said slit in said flow direction when said valve head openable regions are closed.

16. A self-sealing, dispensing valve comprising:

a peripheral attachment portion by which said valve may be attached to a dispensing structure through which can be discharged a product from a supply of said product such that the discharging product generally defines a flow direction from said valve into the ambient environment;

a flexible, peripheral sleeve extending from said peripheral attachment portion, at least part of said sleeve extending generally parallel to said flow direction to a location either outwardly or inwardly of said peripheral attachment portion, said sleeve, when viewed from the ambient environment, has a plan view configuration comprising a central elongate portion and two shorter end portions at opposite ends of said central elongate portion; and a flexible, elongate head extending generally laterally from said peripheral sleeve, said head having a thickness and including at least one elongate slit through said thickness defining two, opposed openable regions in said head which (1) each has at least one transverse face for sealing against a transverse face of said other openable region, and (2) are normally closed but open to permit the discharge of said product therethrough in response to a pressure differential across said head, and wherein a portion of said peripheral sleeve extends in the flow direction to a location inwardly of said peripheral attachment portion; and said head includes at least two elongate slits which intersect to define four segment-shaped petals which (1) each functions as one of said openable regions, and (2) are normally closed but open to permit the discharge of said product therefrom in response to a pressure differential across said head.

17. The valve in accordance with claim 16 in which said head includes at least two spaced-apart pairs of intersecting slits wherein each pair of intersecting slits defines four of said petals.

18. A self-sealing, dispensing valve comprising:

a peripheral attachment portion by which said valve may be attached to a dispensing structure through which can be discharged a product from a supply of said product such that the discharging product generally defines a flow direction from said valve into the ambient environment;

a flexible, peripheral sleeve extending from said peripheral attachment portion, at least part of said sleeve extending generally parallel to said flow direction to a location either outwardly or inwardly of said peripheral attachment portion, said sleeve, when viewed from the ambient environment, has a plan view configuration comprising a central elongate portion and two shorter end portions at opposite ends of said central elongate portion; and a flexible, elongate head extending generally laterally from said peripheral sleeve, said head having a thickness and including at least one elongate slit through said thickness defining two, opposed openable regions in said head which (1) each has at least one transverse face for sealing against a transverse face of said other openable region, and (2) are normally closed but open to permit the discharge of said product therethrough in response to a pressure differential across said head, and wherein said central elongate portion of said peripheral sleeve includes two spaced-apart elongate sidewalls;

said two shorter end portions of said peripheral sleeve each comprise an end wall joining said sidewalls; and said valve is included in combination with a separate housing that retains said valve and that is adapted for being releasably or permanently mounted to said container, said housing including a support wall adjacent each said elongate sidewall for preventing each said sidewall from collapsing beyond said support wall toward the other sidewall, each housing support wall being spaced inwardly of said adjacent sidewall of said sleeve when said valve head openable regions are closed.

19. A self-sealing, dispensing valve comprising:

a peripheral attachment portion by which said valve may be attached to a dispensing structure through which can be discharged a product from a supply of said product such that the discharging product generally defines a flow direction from said valve into the ambient environment;

a flexible, peripheral sleeve extending from said peripheral attachment portion, at least part of said sleeve extending generally parallel to said flow direction to a location either outwardly or inwardly of said peripheral attachment portion, said sleeve, when viewed from the ambient environment, has a plan view configuration comprising a central elongate portion and two shorter end portions at opposite ends of said central elongate portion; and a flexible, elongate head extending generally laterally from said peripheral sleeve, said head having a thickness and including at least one elongate slit through said thickness defining two, opposed openable regions in said head which (1) each has at least one transverse face for sealing against a transverse face of said other openable region, and (2) are normally closed but open to permit the discharge of said product therethrough in response to a pressure differential across said head, and wherein said central elongate portion of said peripheral sleeve includes two spaced-apart elongate sidewalls;

said two shorter end portions of said peripheral sleeve each comprise an end wall joining said sidewalls;

said valve is included in combination with a separate housing that retains said valve and that is adapted for being releasably or permanently mounted to said container, said housing including a support wall adjacent each said elongate sidewall for preventing each said sidewall from collapsing beyond said support wall toward the other sidewall;

said head has (1) an interior surface interfacing with said product, and (2) an exterior surface for interfacing with the ambient environment;

said exterior surface is continuously curving as viewed along a transverse cross section of said valve head;

said interior surface includes a flat area;

said at least one elongate slit lies along an imaginary plane passing through said head; and said head further includes two spaced-apart, short slits which each (1) are generally perpendicular to said at least one elongate slit, (2) are located at an end of said at least one elongate slit, and (3) communicate with said at least one elongate slit so as to define opposed elongate petals functioning as said openable regions wherein each said petal has a long edge and two short edges.

20. A self-sealing, dispensing valve comprising:

a peripheral attachment portion by which said valve may be attached to a dispensing structure through which can be discharged a product from a supply of said product such that the discharging product generally defines a flow direction from said valve into the ambient environment;

a flexible, peripheral sleeve extending from said peripheral attachment portion, at least part of said sleeve extending generally parallel to said flow direction to a location either outwardly or inwardly of said peripheral attachment portion, said sleeve, when viewed from the ambient environment, has a plan view configuration comprising a central elongate portion and two shorter end portions at opposite ends of said central elongate portion; and a flexible, elongate head extending generally laterally from said peripheral sleeve, said head having a thickness and including at least one elongate slit through said thickness defining two, opposed openable regions in said head which (1) each has at least one transverse face for sealing against a transverse face of said other openable region, and (2) are normally closed but open to permit the discharge of said product therethrough in response to a pressure differential across said head, wherein (1) said head includes at least two spaced-apart sets of intersecting slits, and (2) said thickness of said head is non-uniform relative to the location of at least two of said sets of intersecting slits so that a thinner portion of said head is urged further outwardly than a thicker portion of said head when said valve is subjected to said pressure differential whereby the discharge of said product through one of said two sets of intersecting slits is at an relative angle to the discharge of said product through the other set of slits.

* * * * *